US009851093B2

(12) United States Patent
Grigore

(10) Patent No.: US 9,851,093 B2
(45) **Date of Patent: *Dec. 26, 2017**

(54) ELONGATED L.E.D. LIGHTING SYSTEMS, MANUFACTURING AND METHODS TO CONFIGURE THE SAME

(71) Applicant: Valerica Grigore, Longmont, CO (US)

(72) Inventor: Valerica Grigore, Longmont, CO (US)

( * ) Notice: Subject to any disclaimer, the term of this patent is extended or adjusted under 35 U.S.C. 154(b) by 220 days.

This patent is subject to a terminal disclaimer.

(21) Appl. No.: 14/886,024

(22) Filed: Oct. 17, 2015

(65) Prior Publication Data

US 2016/0281937 A1 Sep. 29, 2016

Related U.S. Application Data

(63) Continuation-in-part of application No. 14/672,146, filed on Mar. 28, 2015, and a continuation-in-part of application No. 14/810,714, filed on Jul. 28, 2015.

(60) Provisional application No. 62/208,313, filed on Aug. 21, 2015.

(51) Int. Cl.

| | |
|---|---|
| ***F21V 11/00*** | (2015.01) |
| ***F21V 33/00*** | (2006.01) |
| ***F21S 8/02*** | (2006.01) |
| ***F21V 23/00*** | (2015.01) |
| ***F21S 4/28*** | (2016.01) |
| ***E04F 19/02*** | (2006.01) |
| *F21Y 115/10* | (2016.01) |

(52) U.S. Cl.

CPC ..... *F21V 33/006* (2013.01); *E04F 19/02* (2013.01); *F21S 4/28* (2016.01); *F21S 8/02* (2013.01); *F21V 23/007* (2013.01); *F21Y 2115/10* (2016.08); *Y10T 29/49002* (2015.01)

(58) Field of Classification Search

CPC .... F21V 33/006; F21V 23/007; F21V 23/023; F21V 19/009; F21S 4/28; F21S 5/02; F21Y 2105/10; F21Y 2103/003; F21Y 2103/006; F21K 9/10

See application file for complete search history.

(56) References Cited

U.S. PATENT DOCUMENTS

| | | | |
|---|---|---|---|
| 7,178,941 | B2 | 2/2007 | Roberge et al. |
| 7,296,912 | B2 | 11/2007 | Beauchamp |
| 7,494,258 | B2 | 2/2009 | McNaught |
| 7,658,506 | B2 | 2/2010 | Dowling |
| 7,914,171 | B2 | 3/2011 | Fabbri et al. |
| 8,235,539 | B2 | 8/2012 | Thomas et al. |
| 8,382,314 | B2 | 2/2013 | Ou et al. |
| 8,613,525 | B2 | 12/2013 | Shimizu et al. |
| 8,746,933 | B2 | 6/2014 | Cho et al. |
| 8,764,220 | B2 | 7/2014 | Chan et al. |
| 8,777,448 | B2 | 7/2014 | Shimizu et al. |
| 8,820,964 | B2 | 9/2014 | Gould |
| 8,864,332 | B2 | 10/2014 | Ter-Hovhannisyan |
| 8,888,306 | B2 | 11/2014 | Thomas et al. |
| 8,888,335 | B2 | 11/2014 | Wang |
| 8,926,126 | B2 | 1/2015 | Ronen et al. |
| 8,955,998 | B2 | 2/2015 | Wong et al. |

(Continued)

*Primary Examiner* — Ali Alavi

(57) ABSTRACT

Elongated lighting fixtures intended to be incorporated into thin architectural surfaces, interconnected and configurable as a continuous run with potential to follow the direction of adjacent planar surface in three dimensional spaces while maintaining the structural integrity of the supporting framework.

22 Claims, 21 Drawing Sheets

(56) References Cited

U.S. PATENT DOCUMENTS

| | | | | |
|---|---|---|---|---|
| 8,956,005 | B2 | 2/2015 | Thomas et al. | |
| 9,004,717 | B2 | 4/2015 | Ratkus et al. | |
| 9,004,718 | B2 | 4/2015 | Myers et al. | |
| 9,551,469 | B2 * | 1/2017 | Grigore | F21S 8/02 |
| 2011/0255276 | A1 | 10/2011 | Coward | |
| 2011/0273877 | A1 | 11/2011 | Reed et al. | |
| 2012/0268927 | A1 | 10/2012 | Saito et al. | |
| 2013/0272000 | A1 | 10/2013 | Pearson et al. | |
| 2014/0070724 | A1 | 3/2014 | Gould et al. | |
| 2014/0092596 | A1 | 4/2014 | Deutsch et al. | |
| 2014/0126196 | A1 | 5/2014 | Dixon et al. | |
| 2014/0177209 | A1 | 6/2014 | Carney et al. | |
| 2014/0268720 | A1 * | 9/2014 | Dungan | F21V 23/026 362/218 |
| 2015/0138779 | A1 | 5/2015 | Livesay et al. | |

* cited by examiner

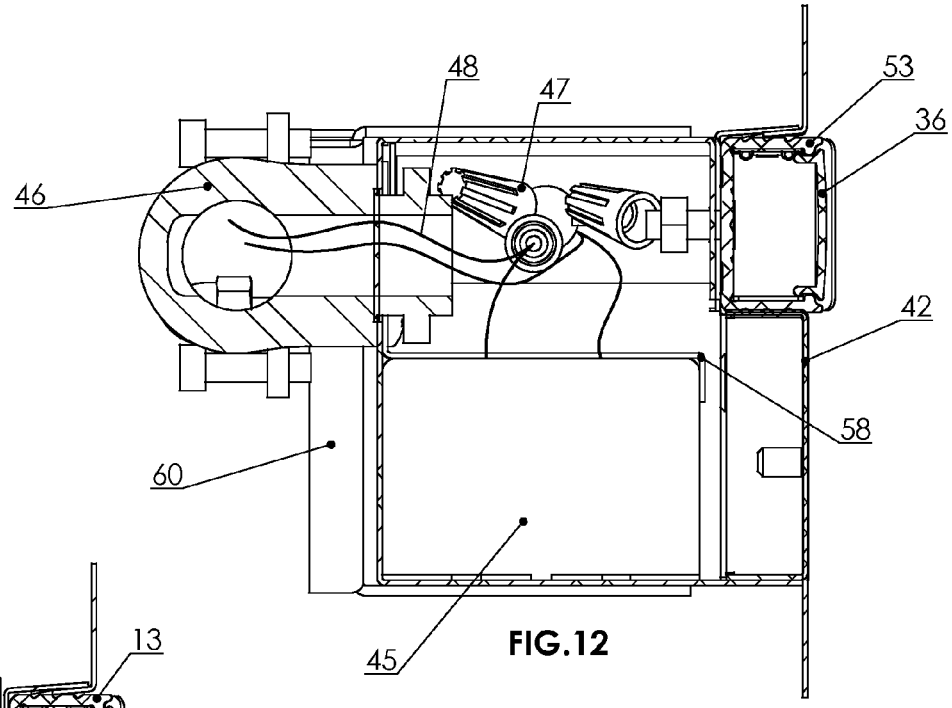
FIG.12
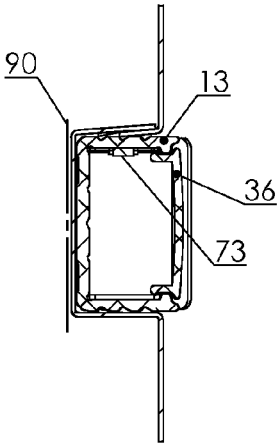
FIG. 13
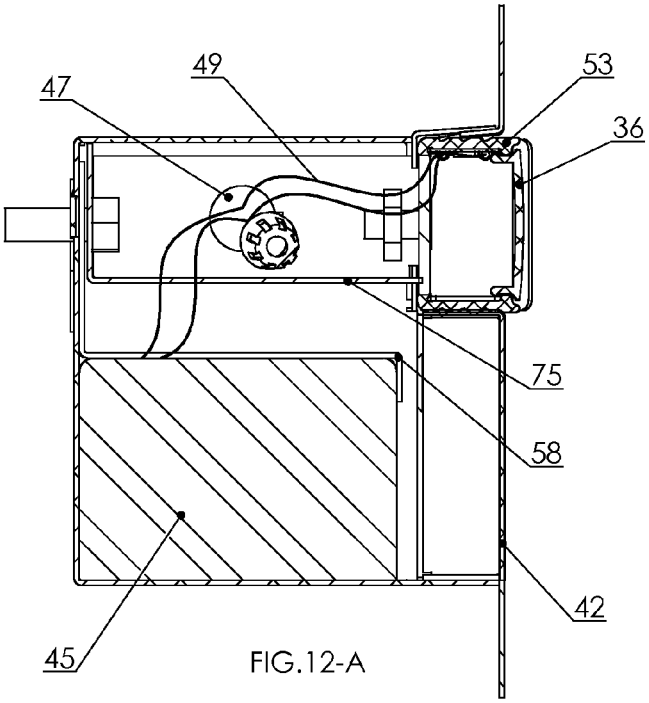
FIG.12-A

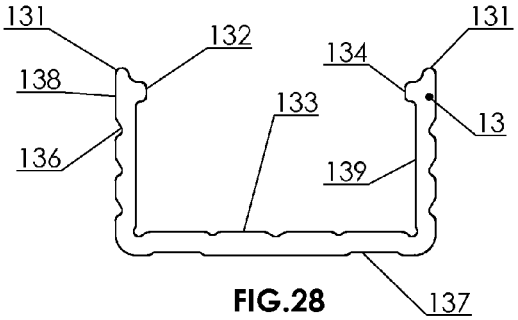
FIG.28
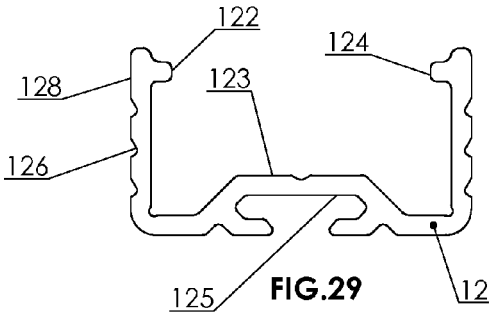
FIG.29
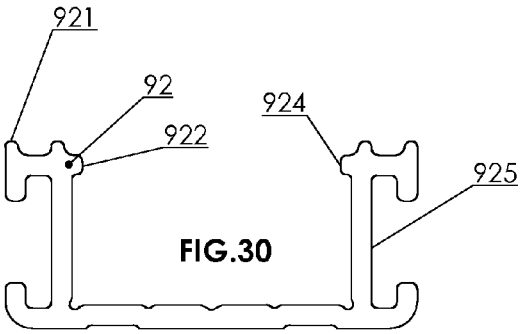
FIG.30
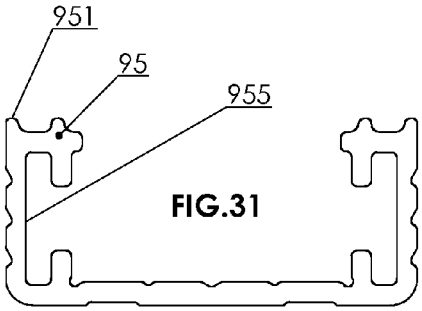
FIG.31
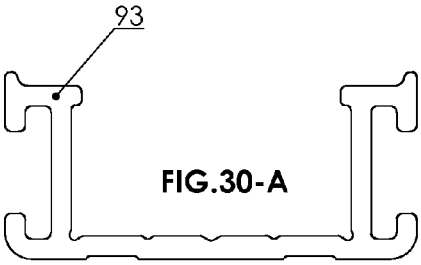
FIG.30-A
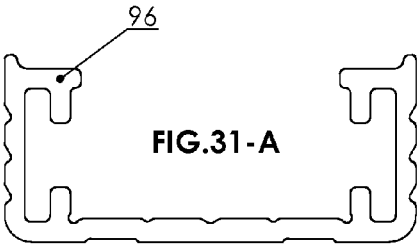
FIG.31-A
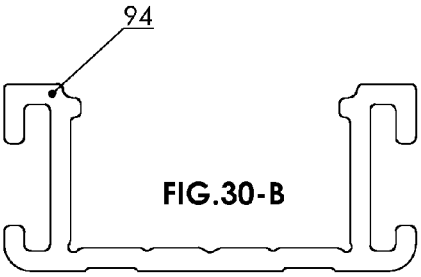
FIG.30-B
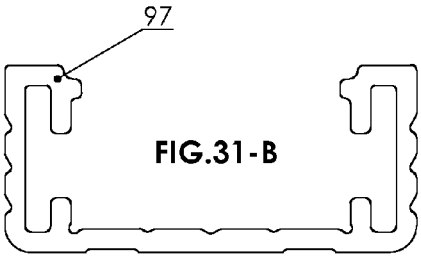
FIG.31-B

ELONGATED L.E.D. LIGHTING SYSTEMS, MANUFACTURING AND METHODS TO CONFIGURE THE SAME

CROSS REFERENCE TO RELATED APPLICATIONS

This application claims priority under 35 U.S.C. §119 to U.S. Provisional Patent Application No. 62/208,313, titled "ELONGATED L.E.D. LIGHTING SYSTEMS, MANUFACTURING AND METHODS TO CONFIGURE THE SAME", filed on Aug. 21, 2015. This application is a continuation-in-part of Utility application Ser. No. 14/672,146, titled "LINEAR LIGHTING SYSTEM, MANUFACTURING AND METHODS TO CONFIGURE THE SAME", filed on Mar. 28, 2015 and U.S. application Ser. No. 14/810,714, titled "ELONGATED L.E.D. LIGHTING SYSTEM, MANUFACTURING AND METHODS TO CONFIGURE THE SAME", filed on Jul. 28, 2015 and incorporated herein by reference.

BACKGROUND OF INVENTION

The majority of small form factor elongated lighting fixtures have their drivers in a remote location due to the fact that there is no room for integral drivers in those types of fixtures. These systems have performance losses caused by their long wires and are more difficult to install than integral driver fixtures.

The remote driver box fixtures are not U.L. approved for battery packs because most of the battery packs should be factory installed not field installed.

The installer have to drill thru every joist up to the last one near the fixture and route the electrical conduit from the remote driver compartment. This is additional labor and it would considerably increase the overall cost related to this job.

International residential building code prescribes limitations for notching and bored holes in both interior and exterior walls.

The decision about the location of the remote driver compartment is left to the installer and he can run into issues when he is limited by the length of the wire due to limitations imposed by manufacturer for power loss in the wire. He has to take extra steps to add up the segments of the wire way path and figure out the total length. In some situations he has to consult other people like the architect, designer, electrical engineer, building owner, contractors, etc. and incur delays due to these complexities.

For existent construction or remodeling there is a risk to interfere with electrical conduit runs, HVAC ducts or plumbing pipes as these are hidden inside the wall and most initial plans are not available or consulted before the work is started.

Those fixtures with integral driver compartment are designed as to allow driver access and maintenance, from the room side, but they require cutting and reframing structural members that are intended to support the walls and/or ceiling. This could extend or invalidate the building approvals required by the code or other authority therefore extending the overall lead time unnecessary.

Traditional shallow elongated recessed fixtures are not usually designed to allow access to replace the light engine while the maintenance of their remote drivers is more difficult than of those fixtures with integral driver.

The warranty for the L.E.D. driver is usually under 5 years while LEDs could have double that lifetime.

The power input of these runs is usually at the end of the fixture. Most of the walls and ceilings would have structural joist members at corner or at the end edges therefore these fixtures are not versatile and are not designed for what is mostly needed: end to end, transition corners, etc.

Most of the other fixtures could not be installed after the planar surface is up, on existent construction. Most of them are for new construction and to be installed before the planar surface is installed.

Various fixtures have been proposed to secure the light sources to the architectural surfaces. Typically, these fixtures have a relatively large depth profile that necessitates excessive clearance space behind the ceiling, wall, or floor surface. In most cases, it may be necessary to reframe a wall to add sufficient depth for the lighting fixture, which may also require cutting and reframing window sills, headers, and other architectural features for structural continuity.

Due to its housing depth and because it's installed to the structure with screws, the integral fixture opening is distorted making the opening variable along the length of the fixture which in turn is not accurate enough to install the light diffusing/converting optical elements like: extruded lens, covers, etc. Additional temporary brackets are used to brace and bridge this opening but they don't eliminate completely the effect and/or they don't control the cause of the distortion (deep housing profile, unknown screw torque force applied by the installed in the field).

SUMMARY OF THE INVENTION

The use of light as an element of design of architectural surfaces is a distinctive trend in modern times. In the near future more and more drivers will be integrated into the L.E.D. board. These are so called IC drivers. We can see that trend in direct line AC L.E.D. boards. These boards are connected directly to main power line without the need of a bulky driver to regulate them. Many consumers will want to convert their fixtures by upgrading their L.E.D. boards and this could eliminate one function of the driver compartment as being the enclosure for an L.E.D. driver but the enclosure will still be needed as storage compartment for the additional L.E.D. tape that is a result of using a tape that is not exactly the length of the concatenated run of fixtures. Also, the enclosure will be needed to contain the wire splices, wire nuts or the electrical connectors used to power the L.E.D. tape. This concept is designed to accommodate both, the current need for a driver compartment and the future upgrade. The future L.E.D. light engines could be housed and be powered directly from the power line integral to the small factor channel housing subject to this design.

In an exemplary embodiment of this invention, an elongated fixture system is designed to be installed without cutting of the structural joist members and could have any direction along the thin surfaces as well as it can be laid out to create formations of various shapes within these surfaces (for example resembling many if not all the capital letters in the alphabet), geometric figures, etc.

The applications of these fixtures are expanded to architectural accent lighting, general/ambient lighting for both, commercial and residential buildings.

The attached driver compartment option is designed to inherit the advantages of the integral fixtures and remove many of their disadvantages. For example a nearby driver would allow short wires between the L.E.D. board and driver therefore reducing considerably the power efficacy loss. The capability to access and replace a faulty driver is another advantage.

Another reason the traditional fixtures are 3" to 5" deep is due to the methods of mixing and diffusing L.E.D. light. The LEDs are oriented directly to the target therefore the point source is visible if it's too close to the lens. Advancements have been done relative to the optics, the diffuser lens are capable to blend the point source into a uniform, glare free, elongated source while allowing smaller distances between the diffuser surface and L.E.D. chips.

The light source could be remote phosphor style, traditional white L.E.D. or any other electroluminescent diode that is capable of generating radiation in response to an electrical signal. For example, the light source of a remote phosphor style would comprise of L.E.D.s installed on a printed circuit board (P.C.B.), that would emit blue light, namely a "blue pump" L.E.D, with the dominant wavelength ranging from 450 nm to 460 nm. Above the P.C.B., at a certain distance around the LED, there would be a material that contains phosphor that is intended to convert the wavelength of the photons emitted by the blue pump LEDs to white light spectrum. This phosphor material is separate and not packaged into the L.E.D. therefore it's known as "remote phosphor".

BRIEF DESCRIPTION OF THE DRAWINGS

The foregoing and other features and aspects of the invention are best understood with reference to the following description of certain exemplary embodiments, when read in conjunction with the accompanying drawings, wherein:

FIG. 12 illustrates section view of a line segment of the concatenated run of elongated fixtures taken along section line 12-12 as labeled in FIG. 10, in accordance with an exemplary embodiment of the present invention;

FIG. 12-A illustrates section view of a line segment of the concatenated run of elongated fixtures taken along section line 12-A-12-A as labeled in FIG. 10, in accordance with an exemplary embodiment of the present invention;

FIG. 13 illustrates section view of a line segment of the concatenated run of elongated fixtures taken along section line 13-13 as labeled in FIG. 10, in accordance with an exemplary embodiment of the present invention;

FIG. 14-A illustrates an isometric view of a gap created in a planar surface;

FIG. 16-A illustrates another isometric view of a gap created in a planar surface;

FIG. 18-A illustrates another isometric view of a gap created in a planar surface;

FIG. 28 illustrates a side view of a light engine housing, component 13, in accordance with an exemplary embodiment of the present invention;

FIG. 29 illustrates a side view of another light engine housing, component 12, in accordance with an exemplary embodiment of the present invention;

FIG. 30 illustrates a side view of a light engine housing, component 92, in accordance with an exemplary embodiment of the present invention;

FIG. 30-A illustrates a side view of another light engine housing, component 93, in accordance with an exemplary embodiment of the present invention;

FIG. 30-B illustrates a side view of another light engine housing, component 94, in accordance with an exemplary embodiment of the present invention;

FIG. 31 illustrates a side view of a light engine housing, component 95, in accordance with an exemplary embodiment of the present invention;

FIG. 31-A illustrates a side view of another light engine housing, component 96, in accordance with an exemplary embodiment of the present invention;

FIG. 31-B illustrates a side view of another light engine housing, component 97, in accordance with an exemplary embodiment of the present invention;

Figure 1:
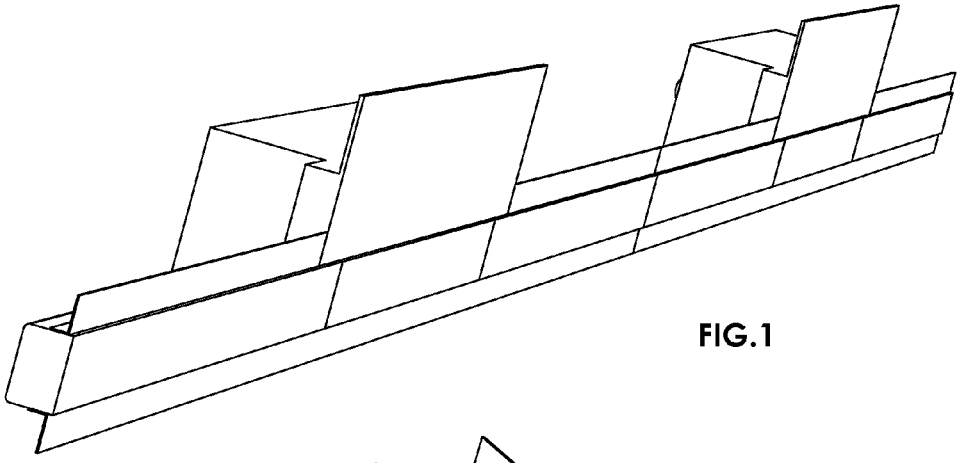
FIG. 1 illustrates an isometric view, frontal perspective, of a line segment of the embodied lighting system, in accordance with an exemplary embodiment of the present invention.
Figure 2:
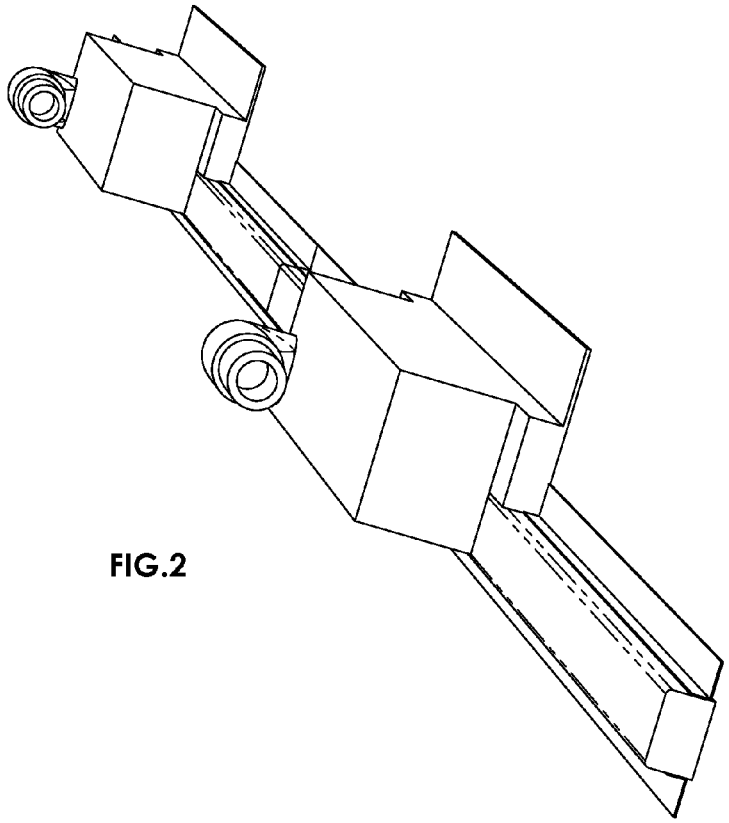
FIG. 2 illustrates an isometric view, rear perspective, of a line segment of the embodied lighting system, in accordance with an exemplary embodiment of the present invention.
Figure 3:
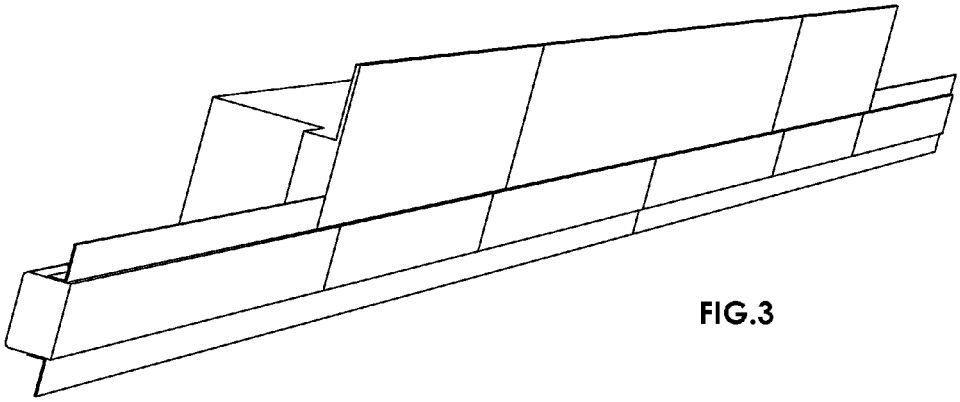
FIG. 3 illustrates an isometric view, frontal perspective, of another line segment of the embodied lighting system, in accordance with an exemplary embodiment of the present invention.
Figure 4:
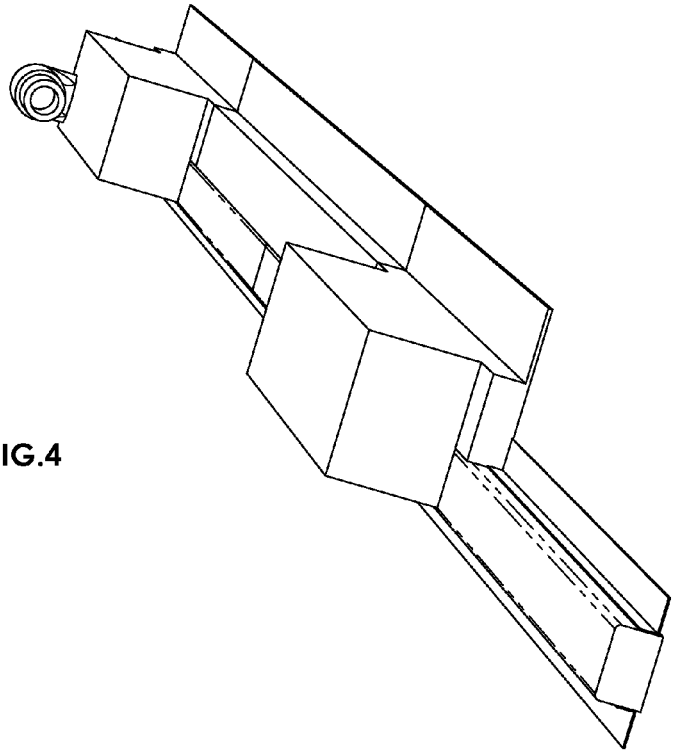
FIG. 4 illustrates an isometric view, rear perspective, of another line segment of the embodied lighting system, in accordance with an exemplary embodiment of the present invention.
Figure 5:
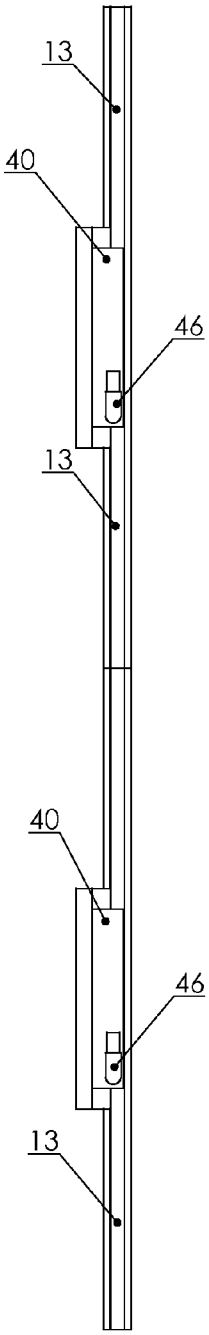
FIG. 5 illustrates a back view of a row of the concatenated run of elongated fixtures having flexible conduit feeding each driver enclosure in that row, in accordance with an exemplary embodiment of the present invention.
Figure 6:
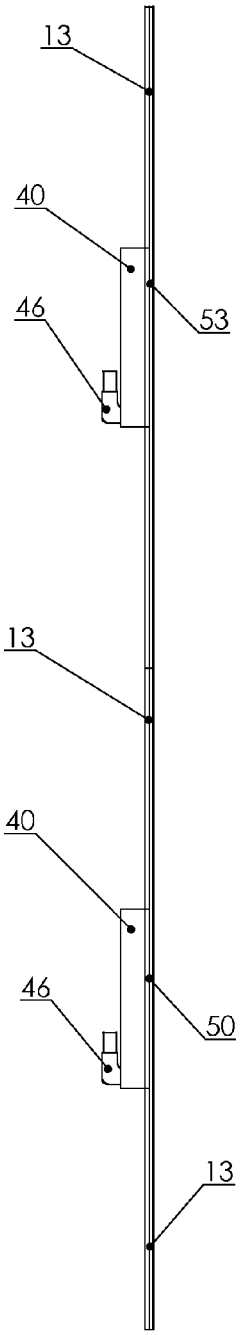
FIG. 6 illustrates a top view of a row of the concatenated run of elongated fixtures having flexible conduit feeding each driver enclosure in that row, in accordance with an exemplary embodiment of the present invention.
Figure 7:
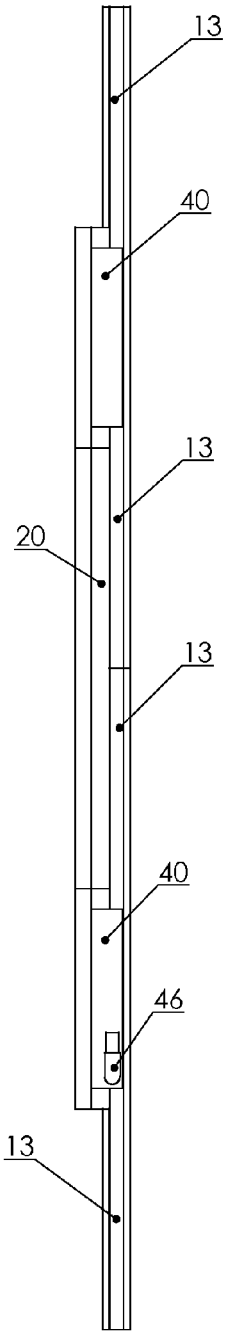
FIG. 7 illustrates a back view of a row of the concatenated run of elongated fixtures having power supply fed to one selected driver enclosure in that row and attached wire chase extrusions 20 to deliver the power from the selected driver enclosure to the remaining driver enclosures, in accordance with an exemplary embodiment of the present invention.
Figure 8:
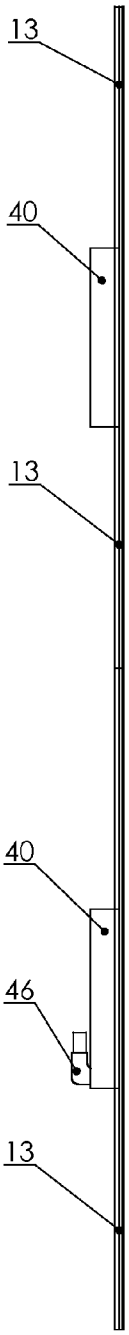
FIG. 8 illustrates a top view of a row of the concatenated run of elongated fixtures having power supply fed to one selected driver enclosure in that row and attached wire chase extrusions to deliver the power from the selected driver enclosure to the remaining driver enclosures, in accordance with an exemplary embodiment of the present invention.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF INVENTION

The present invention is focused on methods to configure elongated lighting in different interior building spaces. Although the description of exemplary embodiments is provided below in conjunction with interior building structures, alternate embodiments of the invention are applicable to other illuminated open spaces including, but no limited to, transit, tunnels, staircase, sidewalk, landscape, bollards, parking and other outdoor areas. Furthermore, although the invention has been described with reference to specific methods to configure elongated lighting fixtures embedded into interior and exterior architectural surfaces, these descriptions are not meant to be construed in a limiting sense to these applications but a disclosure to apply these concepts to other related applications as recessed lighting applications, cove, surface mount, suspended or track lighting.

Furthermore, although some embodiments of the invention have been described with reference to specific methods to configure elongated lighting fixtures, it is within the scope of the invention to apply the same concept to any elongated fixture or to a fixture substantially longer than its width. In one embodiment, the invention is an elongated lighting fixture, intended to be installed on a structure without altering the structural members of its framework comprising: an elongated lighting fixture, intended to be installed on a structure without altering the structural members of its framework, comprising: an enclosure, mounted on at least one structural member, wherein said enclosure is sufficiently recessed behind its mounting surface and containing an electrical device used as a power source and control; a channel segment, adjoined said enclosure and mounted on at least one structural member bearing an opening to access said adjoining enclosure; a junction box, adjoined to said channel and located inside said enclosure; a channel housing, abutted to and aligned with said channel segment and mounted on at least one structural member; a wire way chase, mounted on at least one structural member, side by side and in the same direction with said channel; a covering and anchoring surface for said wire way chase; a light source, containing electroluminescent diodes, mounted in said channel, and connected to said electrical device; and, a removable cover, mounted on said channel; wherein said channel would have at least one opening for maintenance access to said power source, after said fixture installation;

In a variation of the embodiment above, the enclosure is placed anywhere along the gap, between the structural members.

In another exemplary embodiment, the invention is an elongated light fixture housing comprising: a channel housing, having one or more complementary located flexible locking features; a removable cover, having one or more complementary located flexible locking features; wherein said complementary located flexible locking features engage functioning as a snap-fit cover attachment system for the elongated light fixture.

In another exemplary embodiment, the invention is an elongated light fixture housing comprising: a channel housing, comprising an outer surface and an inner surface, having at least one indentation integrally formed on its inner surface, in at least one of its side walls; and a removable cover, comprising an outer surface and an inner surface, having at least one complementary indentation integrally formed on its outer surface; wherein said indentation of said channel is for receiving and retaining said complementary indentation of said removable cover and functioning as a snap-fit attachment system of said cover to said channel.

The term "L.E.D." is known in the art and relates to Light-Emitting Diode: a semiconductor diode that emits light when an electric current passes thru it as a result of a specific voltage applied to its terminals.

The term "L.E.D. driver" is known in the art and relates to an electrical device that manages power and controls the current flow to an L.E.D. lighting source. The electrical device is connected to a power source.

The term "driver enclosure" (abbreviated as D.E.4) is related to the L.E.D. driver enclosure, component 40 in our description, and is known in the art as the electrical enclosure housing the L.E.D. driver and constituting a part of the luminaire intended to:

(a) reduce the risk of contact with live parts;
(b) enclose electrical parts and components that can involve a risk of fire;
(c) protect internal parts from mechanical damage; and
(d) protect internal parts from the environment.

The term "internal junction box" is an enclosure functioning as a compartment to separate the low voltage wiring circuit from the high voltage branch wiring circuit. The branch wiring compartment must be enclosed in a space with a minimum volume of 6 cubic inches, per U.L. standard 1598.

The term "opening" should be construed per Underwriters Laboratories (U.L.) definition as "an aperture in an enclosure that is covered or filled by a plug or knockout and that has the potential of becoming an open hole".

The term "knockout" (abbreviated as K.O.) relates to a partially cut-out opening that is closed until the precut material is removed. A similar explanation should be related to the term "half-shear" that will be used in our detailed description of the invention embodiment.

The term "heat sink" should be construed as a material of a particular shape intended to absorb excessive heat from a surface and dissipate that heat thru other surfaces.

The term "countersink" should be construed as a conical hole cut into a manufactured object.

The term "plaster" should be construed as "a mixture of lime or gypsum, sand, and water, sometimes with fiber added, that hardens to a smooth solid" and is used for coating walls and ceilings.

The term "spackle" is a trademark referencing a compound used to fill cracks in plaster and produce a smooth surface.

The term "spackle flange" is known in the art as that lighting fixture component that is placed in contact with architectural surfaces for the purpose of applying spackle on top of it and bonding the fixture housing to the architectural surface. Alternatively, in another embodiment, the term "covering and anchoring surface" is largely used in reference to the "spackle flange" component but it's not intended to be limited to that particular embodiment.

The term "elbow fitting" is used in piping and electrical fittings to define a change of direction of an electrical conduit at a specific angle (usually 90 degrees).

The term "hinge joint" is used in some embodiments of this invention to define an articulation that would allow motion only in one plane.

For the purpose of this invention, the term "structure" is used in reference to the framework of a building such as an edifice for commercial, residential and industrial space or any other construction establishment.

The term "stud" is known as a building material that is used to construct the frame of that structure.

The term "recessed" is used, in this invention, to define a setback position of a component relative to a planar surface or a mounting surface.

The term "channel" is used to reference an element having an elongated base, a first and a second wall, first wall disposed at a certain distance from the second wall, and extending from the base in a common direction therefore forming a cavity with two open ends.

The abbreviation "H.V.W.C.3" meaning "High Voltage Wire Channel" is in reference to component 20 of the lighting fixture segment. Alternatively, in another embodiment, the features of component 13 are combined with the features of component 20 to form one piece construction and this new component would be named "channel with integral wire way chase".

The abbreviation "P.I.S./H.-L.E." meaning "Power Input Segment/Housing for Light Engine" is in reference to component 53 of the lighting fixture segment; Alternatively, in another embodiment, the term "channel segment" is used in reference to component 53, within the scope of the invention, but not limited to that particular embodiment. The abbreviation "T-slot" represents a groove cut into a material, like aluminum, with a tool having the shape of letter 'T', like an extrusion tool.

In an exemplary embodiment, a fastening method is employed to secure at least two components by interlocking their own features (fastening by shape) or by using intermediate fasteners like screws, clips, clasps, glue, etc.

A "snap-fit" is a mechanical joint system where part-to-part attachment is accomplished with locating and locking features (constraint features) that are homogenous with one or the other of the components being joined. Joining requires the (flexible) locking features to move aside for engagement with the mating part, followed by return of the locking feature toward its original position to accomplish the interference required to latch the components together . . . "—*The First Snap-Fit Handbook*", Bonenberger, 2000 is incorporated herein by reference. Some examples of locking features are: hooks, ridges, grooves, buttons, holes, depressions, indentations, etc.

Descriptions of snap-fit joints can be found in US patent application no. US20070000922 A1 and U.S. Pat. No. 5,102,253 A incorporated herein by reference. Snap-fits joints advantageously eliminate other joining methods, e.g. screws, clips, and adhesives.

For the purpose of this invention, the term "groove" is a long, narrow cut or depression, especially one made to guide motion or receive a corresponding ridge.

For the purpose of this invention, the term "rib" is a long raised piece of stronger or thicker material across a surface or through a structure.

The term "co-extruded" is used when more than one plastic material is pressed, in the same time, thru the same die, to produce a single piece part;

For the purpose of defining directionality, a coordinate system needs to be related to an elongated segment of the lighting system having a light emitting surface normal to Z axis of a cartezian coordinate system while its length is defined in the X direction and its width in Y direction.

Figure 14:
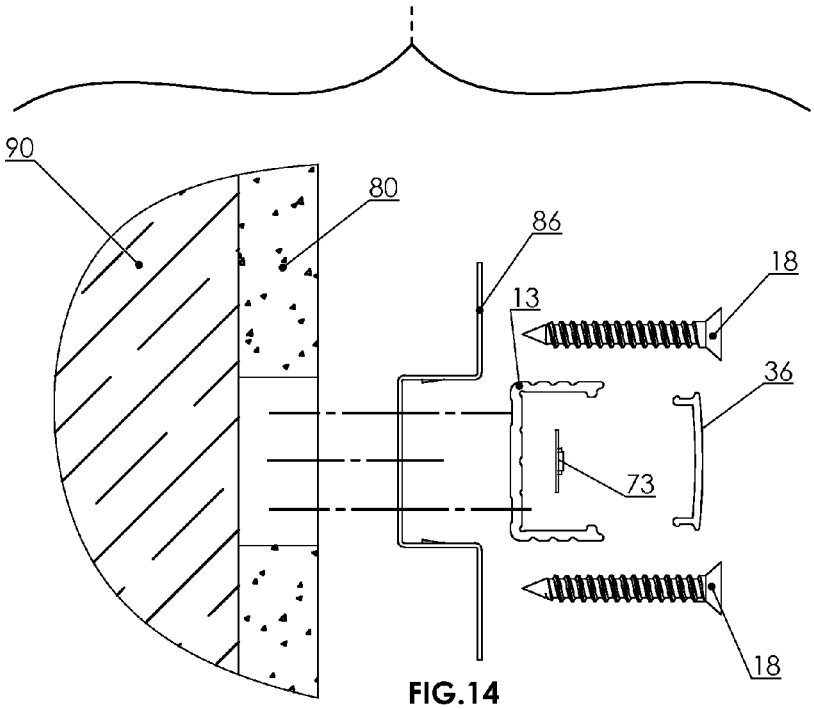
FIG. 14 illustrates an exploded view of a line segment of the concatenated run of elongated fixtures to be installed in a planar surface, in accordance with an exemplary embodiment of the present invention.

In an exemplary embodiment, depicted in FIG. 14-A, a planar surface could be a wall 80 that is constructed from one or more drywall sheets arranged on a conventional stud frame. A gap of predefined shape could be created by removing a portion or portions from the one or more drywall sheets. Alternatively, the lighting fixture may first be installed on the studs 90 and the wall may be added later. In other embodiments, the wall may be constructed of wallboard, lathing for plaster, wood, or any other material used to construct an architectural surface.

Figure 15:
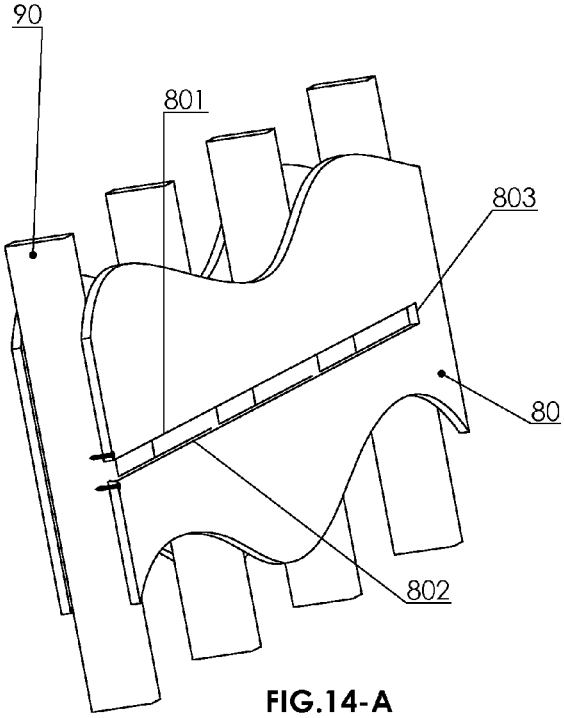
FIG. 15 illustrates a side view of a line segment of the concatenated run of elongated fixtures installed in a planar surface, in accordance with an exemplary embodiment of the present invention.
Figure 15:
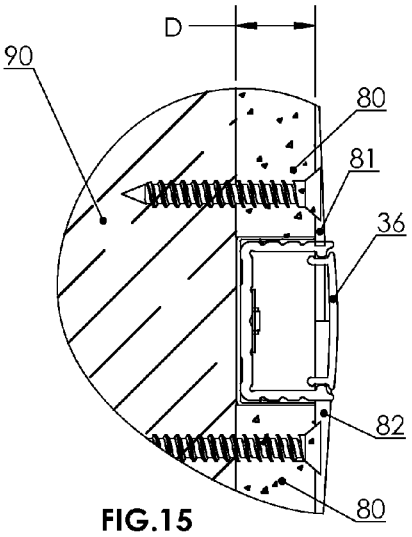
Figure 16:
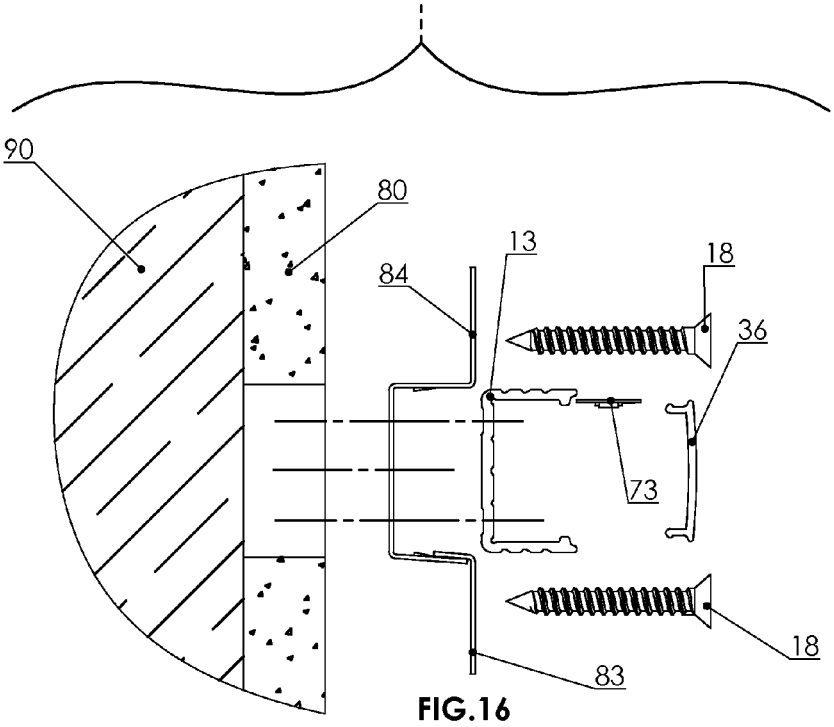
FIG. 16 illustrates another exploded view of a line segment of the concatenated run of elongated fixtures to be installed in a planar surface, in accordance with an exemplary embodiment of the present invention.
Figure 17:
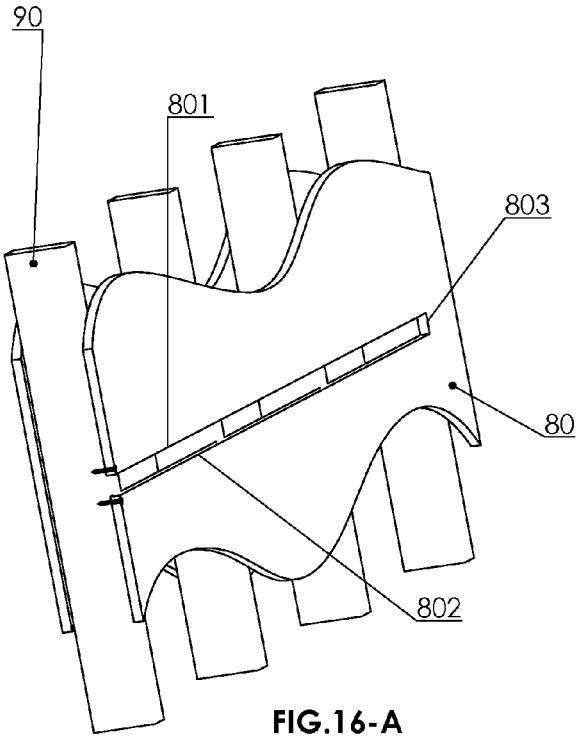
FIG. 17 illustrates a side view of a line segment of the concatenated run of elongated fixtures installed in a planar surface, in accordance with an exemplary embodiment of the present invention.
Figure 17:
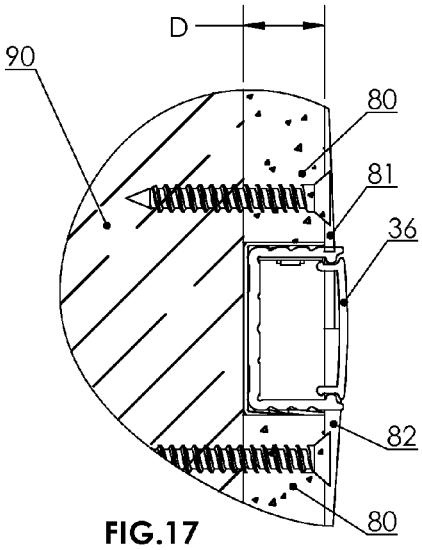

As illustrated by FIG. 14-A, the basic shape of the gap for an elongated segment fixture could have two parallel edges 801 and 802 and it might have an end similar to edge 803. The main components of the slim form factor fixture segment are comprised of: aluminum extruded light engine housing 13, light diffusing/converting optical element 36 and L.E.D. light engine 73, as depicted by FIG. 14. A side view of the main components is illustrated by FIG. 15, while FIG. 14 is intended to clarify the profile of these components in an exploded view. A similar scenario is depicted by FIG. 16, except the light engine 73 is installed on the side wall of the light engine housing 13. A side view of the main components is illustrated by FIG. 17 while FIG. 16 is intended to clarify the profile of these components in an exploded view.

Figure 18:
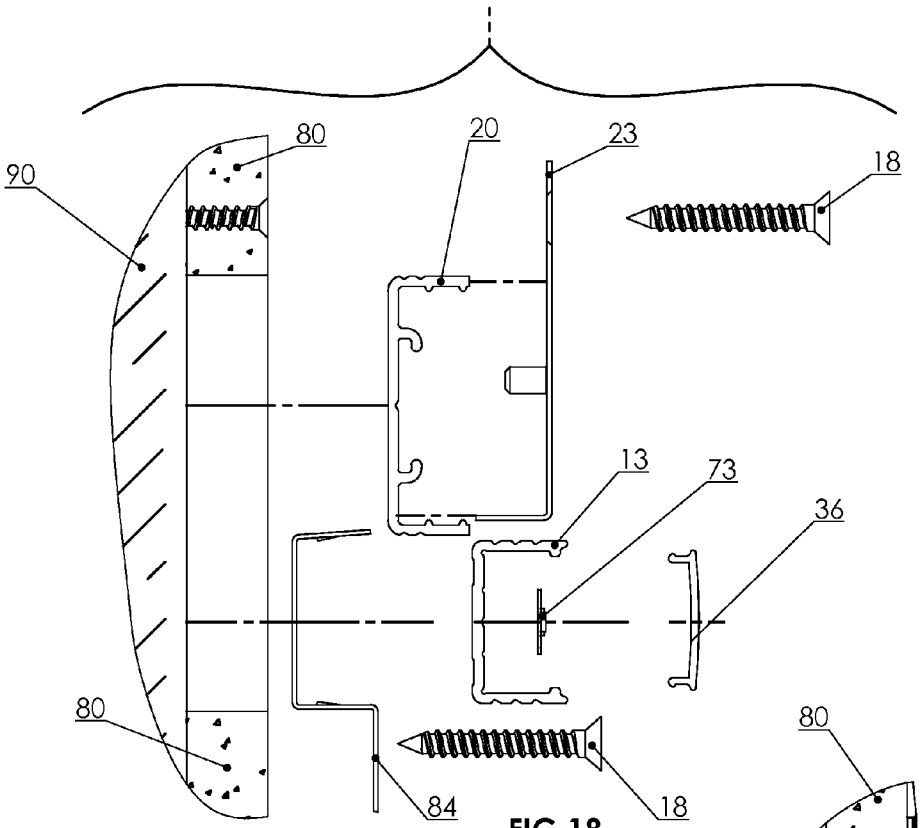
FIG. 18 illustrates an exploded view of a line segment of the concatenated run of elongated fixtures to be installed in a planar surface along with additional high voltage wireway, in accordance with an exemplary embodiment of the present invention.
Figure 19:
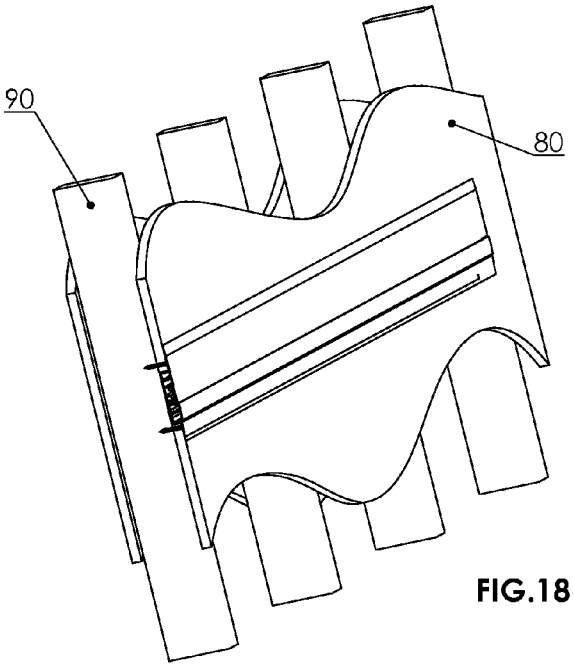
FIG. 19 illustrates a side view of another line segment of the concatenated run of elongated fixtures installed in a planar surface along with additional high voltage wireway, in accordance with an exemplary embodiment of the present invention.
Figure 19:
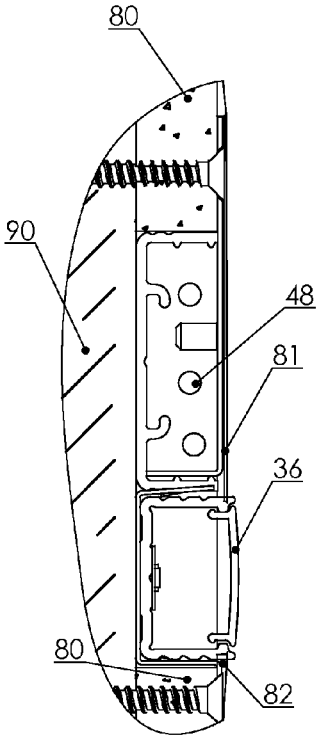

When a high voltage wire way channel H.V.W.C.3 is needed between the L.E.D. driver compartments, a "spackle flange/cover" version could be installed, as illustrated by FIG. 18. The main components of the "spackle flange/cover" fixture segment are comprised of: separate extruded high voltage wireway chase mounted on one side of the LED strips housing, component 20, spackle flange/cover 23 installed to the planar surface with the screws 18, aluminum extruded light engine housing 13, light diffusing/converting optical element 36, and L.E.D. light engine 73. A side view of the main components is illustrated by FIG. 19 with the wire 48 installed inside the H.V.W.C.3, while FIG. 18 is intended to clarify the profile of these components, in an exploded view.

Figure 60:
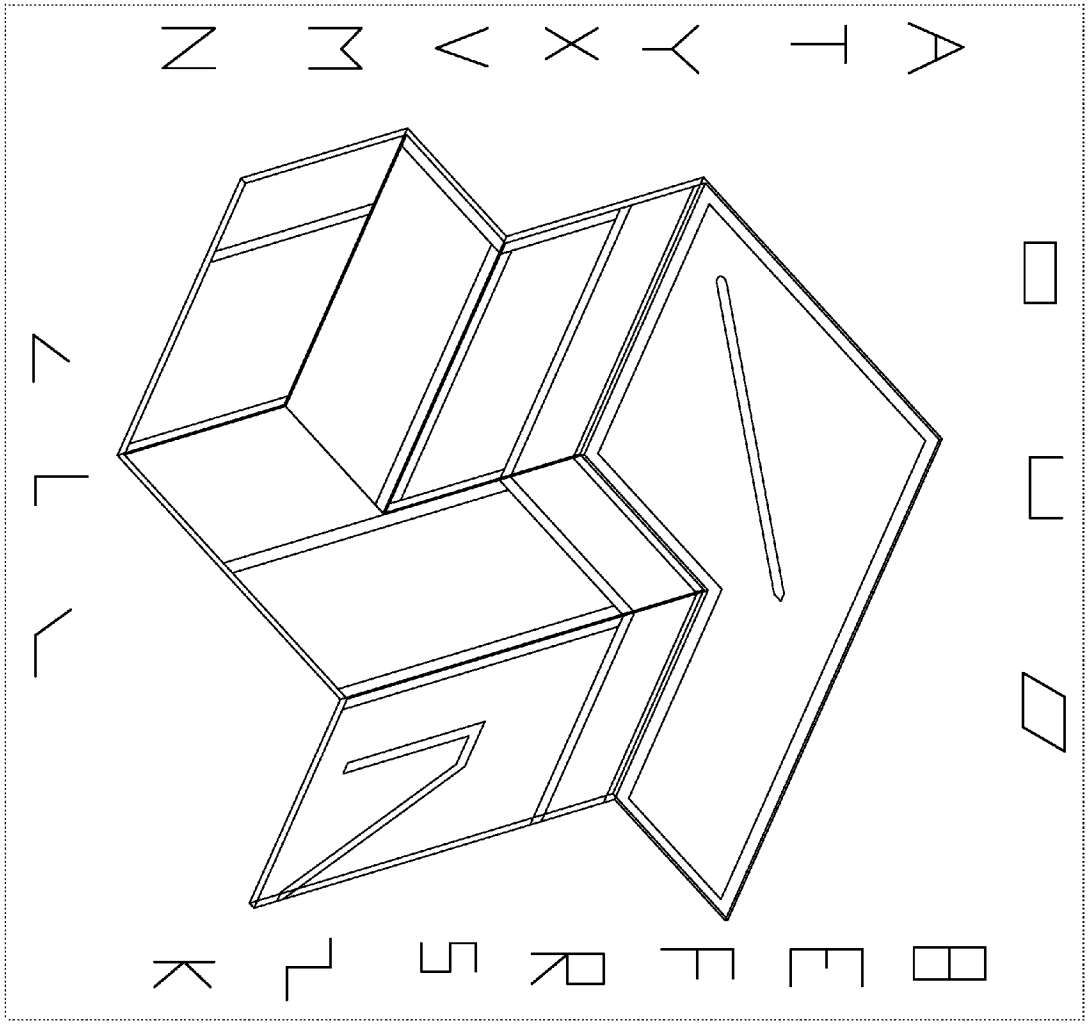
FIG. 60 illustrates a perspective view of some geometrical figures that could be created on three dimensional planar surfaces utilizing the lighting system in accordance with an exemplary embodiment of the present invention.

In an exemplary embodiment, a gap of predefined shape might be formed in the planar surface similar to a concatenated sequence of "open" line segments with different angles between them. As seen in FIG. 60, shapes resembling alphabet letters (A,U,C,H,K,L,M,N,T,V,X,Y,Z) could be created on existent architectural surfaces as well as many other geometric figures.

In an exemplary embodiment, as depicted in FIG. 28, an important component of the fixture is the aluminum extruded channel/light engine housing 13. Other variations of an extruded channel/light engine housing could be components 12 depicted in FIG. 29, or component 91 depicted in FIG. 32, or component 98 depicted in FIG. 33, or component 92 depicted in FIG. 30, or component 93 depicted in FIG. 30-A, or component 94 depicted in FIG. 30-B, or component 95 depicted in FIG. 31, or component 96 depicted in FIG. 31-A, or component 97 depicted in FIG. 31-B. The component 20, depicted in FIG. 34, it was intended as H.V.W.C.3 but could be used as a light engine housing. This component and its variations, could be an aluminum extrusion that may or may not be painted depending on certain circumstances. Other preferred materials to manufacture this part are the heat conductive materials and/or materials with electrical insulator properties. Some of its features, as referenced in FIG. 28 or FIG. 30 or FIG. 31: 131 (and its variations 921, 951) are 'walls' intended to be a protective barrier to block particles, like those of the spackle compound 81, 82 or those of the planar surface 80 illustrated in FIG. 15, from reaching the lens 36 or the light source 73.

Figure 32:
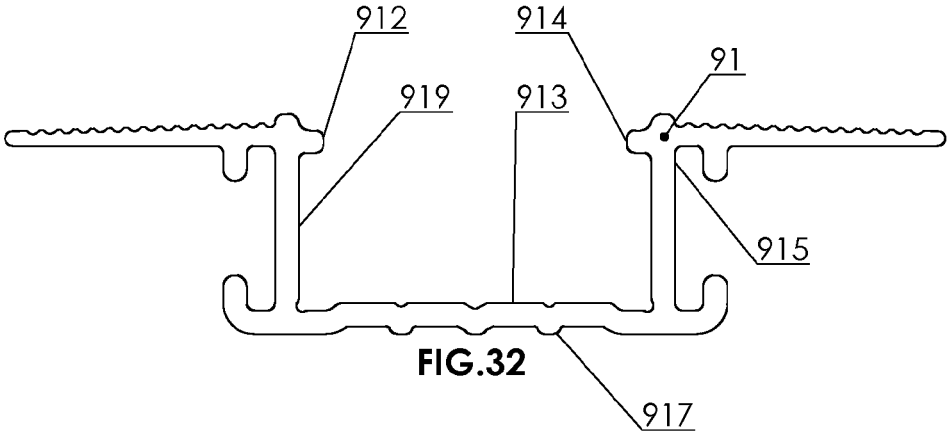
FIG. 32 illustrates a side view of a light engine housing, component 91, in accordance with an exemplary embodiment of the present invention.
Figure 33:
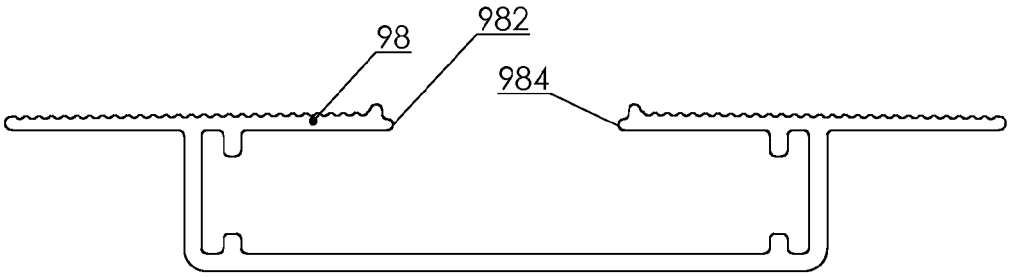
FIG. 33 illustrates a side view of a light engine housing, component 98, in accordance with an exemplary embodiment of the present invention.
Figure 49:
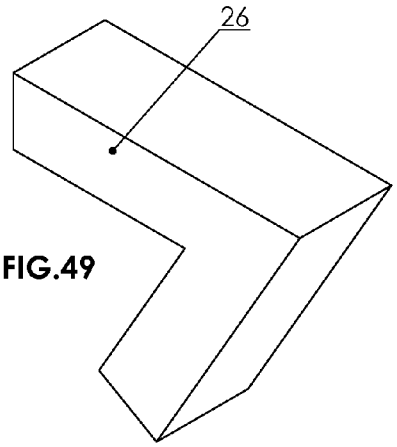
FIG. 49 illustrates an isometric view of an acute corner alignment block, component 26, in accordance with an exemplary embodiment of the present invention.
Figure 50:
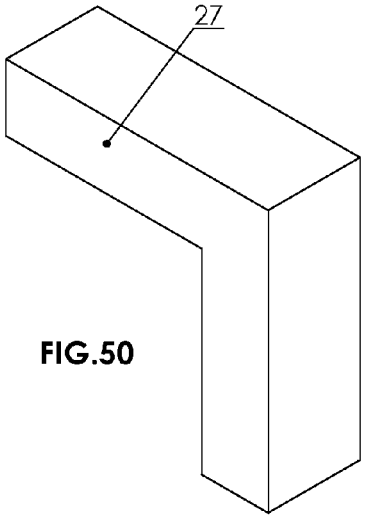
FIG. 50 illustrates an isometric view of a normal corner alignment block, component 27, in accordance with an exemplary embodiment of the present invention.
Figure 51:
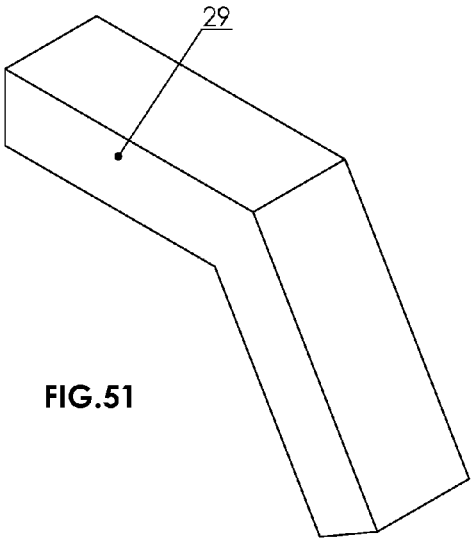
FIG. 51 illustrates an isometric view of an obtuse corner alignment block, component 29, in accordance with an exemplary embodiment of the present invention.
Figure 52:
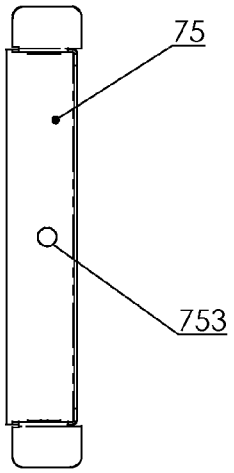
FIG. 52 illustrates a top view of component 75, named "internal junction box", in accordance with an exemplary embodiment of the present invention.
Figure 53:
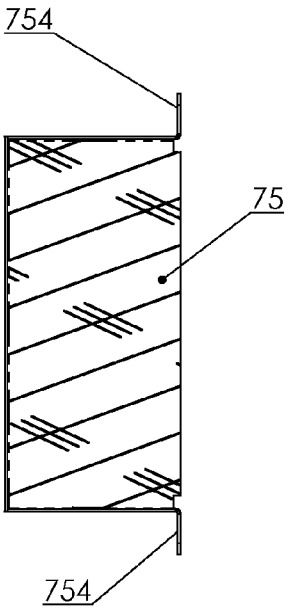
FIG. 53 illustrates a front view of component 75, named "internal junction box", in accordance with an exemplary embodiment of the present invention.
Figure 54:
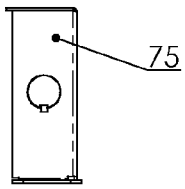
FIG. 54 illustrates a side view of component 75, named "internal junction box", in accordance with an exemplary embodiment of the present invention.

The surface 138 or 128 might be exposed or visible surfaces, in some configurations, therefore serving as a decorative surfaces, with a required finish. The protrusions 132 and 134 (respectively 122 and 124, or 912 and 914, or 922 and 924, or 982 and 984) could be one or multiple pairs intended to retain the lens 36 or other lens variations 39, while they are inserted into the channel housing. They are also designed to allow the removal of the lens while a thin object is inserted, between the lens and the housing, and acceptable force is applied on that object. The surface 133 (or 139) is a mounting surface for the L.E.D. light source 73. The top surfaces 131, 921 or 951 are visible from the room side therefore their alignment is important as they have to be perceived as continuous line independent of the number of fixtures that are in the row. The features 125, 915, 925, 955 or 205 could be described as a 'T' slot. This is intended as a receiver slot for corner cleats or alignment plates as those depicted in FIG. 29 thru FIG. 34. The same slots could be used as screw chase feature designed to receive self tapping screws installed from the end. Those screws are used to secure the end caps of a continuous run. The surface 133 or 139 is also the surface where the installer would drill holes to secure the fixtures to the structure with wood screws. For those channels with 'T'-slots, as depicted in FIG. 29 thru FIG. 34, the surface 123, 913 or 919 could have pre-drilled holes to align and pull the extrusions together with the help of self tapping flat head screws and by using aligner plates- or corner cleats, described in detail in application Ser. No. 14/672,146 incorporated herein by reference. The aligners 26, 27 or 29 depicted by FIG. 49, FIG. 50 respectively by FIG. 51, could each be a guide to align the aluminum extrusions/channels, before the lens 36 are installed. These aligners are to be removed after the extruded channels 13 are secured with screws and before the light engines 73 are laid out. The grooves 136 or 126, as labeled in FIG. 28 thru FIG. 29 are intended for mounting these extrusions, to the structure, with the help of a few clips, component 15, as exemplified in FIG. 59. The ribs 137 or 917, depicted in FIG. 28 and FIG. 32, are intended to increase the heat transfer surface on the opposite side of surface 133, where the light engine is installed, and could be considered as heat sink fins.

Figure 26:
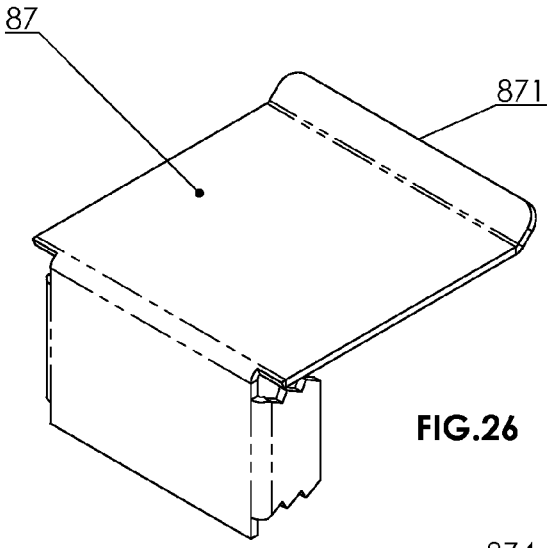
FIG. 26 illustrates an isometric view, frontal perspective, of a tape collector endcap element 87, in accordance with an exemplary embodiment of the present invention.
Figure 27:
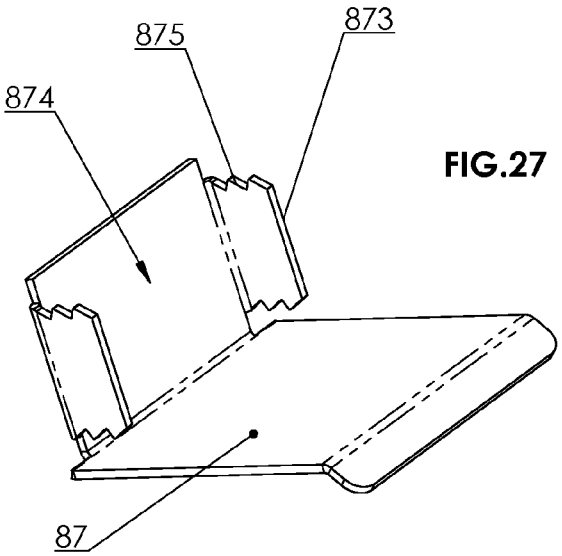
FIG. 27 illustrates an isometric view, rear perspective, of a tape collector endcap element 87, in accordance with an exemplary embodiment of the present invention.

At the ends of the continuous row or on a standalone fixture we would install end caps. One exemplary embodiment, depicted in FIG. 26 and FIG. 27 is component 87. This could be made out of injection molded plastic materials, metal casting, sheet metal or other manufacturing methods well known in the industry. The end cap could be opaque, translucent or transparent. The feature 873 would match the inside of the light engine housing and would guide and locate the end cap relative to the light engine. The jagged features 875 are intended to help with the attachment of the end cap to the channel, working similar to fastening with 'hooks', when the end cap is pressed fit inside the channel, eliminating the need to use screws. If the end cap is opaque, it is recommended that the surface 874 is highly reflective. The top edge 871 is intended to match the outside profile of light diffusing/converting optical elements to avoid visible discontinuity in a row of fixtures. An important role of an end cap is to mitigate the light 'leakage' by minimizing the gaps at the end. Another role of the end cap is to mitigate the gaps created due to the thermal expansion/contraction of different materials. The thermal expansion/contraction needs to be taken into consideration between multiple segments of a row.

Figure 34:
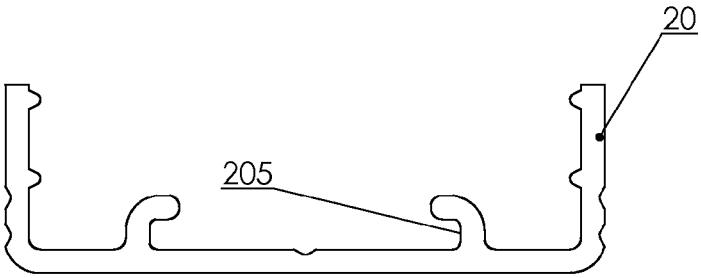
FIG. 34 illustrates a side view of a high voltage wire way chase, component 20, in accordance with an exemplary embodiment of the present invention.

Another component of some lighting fixtures, especially those configurations with more than one D.E.4 in a row, is the high voltage wire way chase, item 20, as illustrated in FIG. 34. This component could be made out of extruded aluminum. FIG. 19 illustrates the space where the high voltage wire 48 will be located inside the H.V.W.C3. The feature 205 is a T-slot feature intended for alignment plates or corner cleats.

Figure 20:
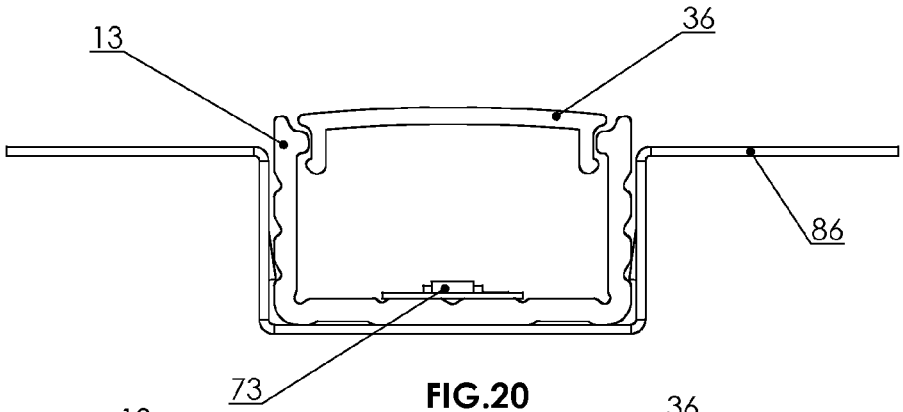
FIG. 20 illustrates a side view of an L.E.D. light source 73 installed on the bottom surface of a light engine housing, component 13, installed within the spackle flange 86 and assembled with the lens, component 36, in accordance with an exemplary embodiment of the present invention.
Figure 21:
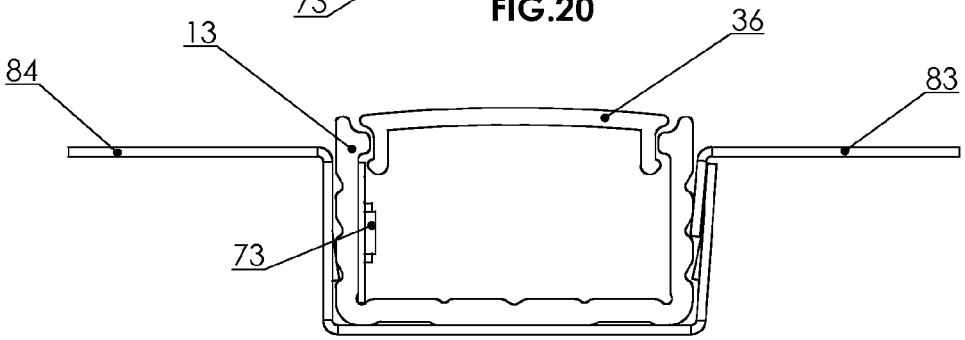
FIG. 21 illustrates a side view of an L.E.D. light source 73 installed on one side surface of a light engine housing, component 13, installed within two piece construction spackle flange 83 and 84, and assembled with the lens, component 36, in accordance with an exemplary embodiment of the present invention.
Figure 35:
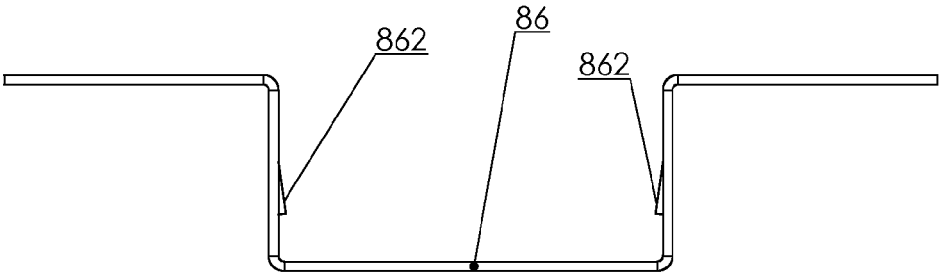
FIG. 35 illustrates a side view of the spackle flange, one piece construction, component 86, in accordance with an exemplary embodiment of the present invention.
Figure 36:
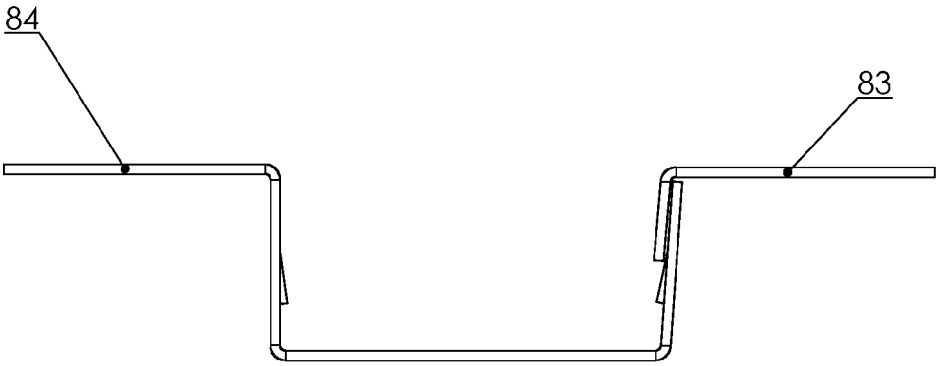
FIG. 36 illustrates a side view of the spackle flange, two piece construction, components 83 and 84, in accordance with an exemplary embodiment of the present invention.
Figure 37:
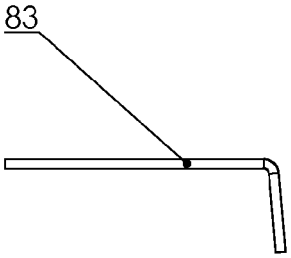
FIG. 37 illustrates a side view of the spackle flange-one side, component 83, as if mounted on the left hand side of a fixture, in accordance with an exemplary embodiment of the present invention.
Figure 38:
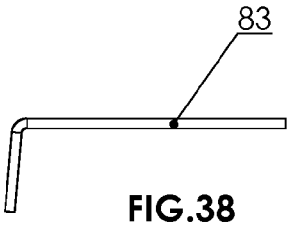
FIG. 38 illustrates a side view of the spackle flange-one side, component 83, as if mounted on the right hand side of a fixture, in accordance with an exemplary embodiment of the present invention.
Figure 39:
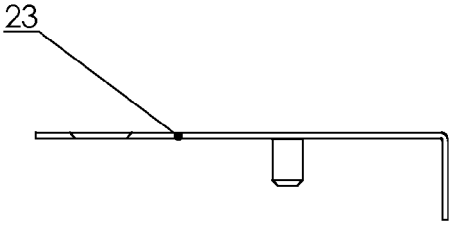
FIG. 39 illustrates a side view of the spackle flange/cover, component 23, in accordance with an exemplary embodiment of the present invention.
Figure 40:
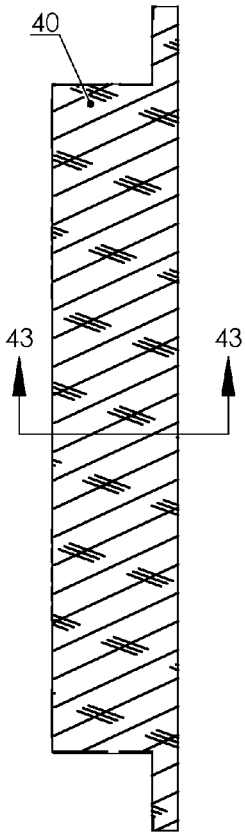
FIG. 40 illustrates a top view of component 40, named 'L.E.D. driver enclosure', in accordance with an exemplary embodiment of the present invention.
Figure 41:
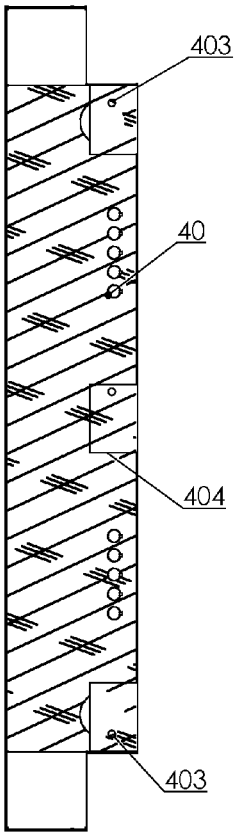
FIG. 41 illustrates a front view of component 40, named 'L.E.D. driver enclosure', in accordance with an exemplary embodiment of the present invention.

Another component of the lighting fixtures, exemplified in FIG. 39 and FIG. 18, is the spackle flange/cover 23, described in detail in application Ser. No. 14/810,714 incorporated herein by reference. A variation of a spackle flange concept, intended for a recessed light engine without wire way chase, is depicted by FIG. 35, component 86, one piece construction. The features 862 are protrusions formed in the component 86 intended to retain the channels 13 or its variations, and working as a snap-fit attachment when put in contact with the grooves 136 of component 13 as depicted by FIG. 20. Another variation of the spackle flange concept is depicted by FIG. 36, where two piece construction, component 83 and 84 are assembled to satisfy a symmetrical spackle layout or component 84 could be used alone for an asymmetrical (one side) spackle layout. In another variation, component 83 could be used on one side of the light engine or on both sides.

Figure 47:
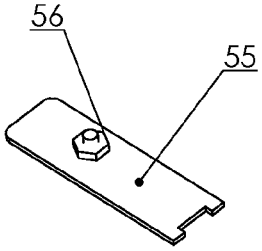
FIG. 47 illustrates an isometric view of component 55, named 'access door', in accordance with an exemplary embodiment of the present invention.
Figure 48:
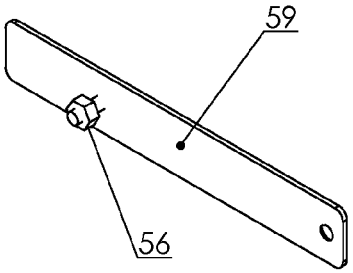
FIG. 48 illustrates an isometric view of component 59, named 'power access cover', in accordance with an exemplary embodiment of the present invention.

Another component of the lighting fixtures, exemplified in FIG. 47, is the access cover 55, preferably made of sheet metal (aluminum or steel) but could also be an extruded aluminum component with secondary operations. Similar materials could be used for component 59 power access cover, exemplified in FIG. 48. Grounding screw 56 needs to be factory installed. This could be pre-installed with grounding wire, eyelet, nut and star washer (not shown). Alternatively, the access covers could be installed directly to the driver enclosure D.E.4 with screws, thus ensuring the bonding between these components without the need to install additional grounding screws.

Figure 22:
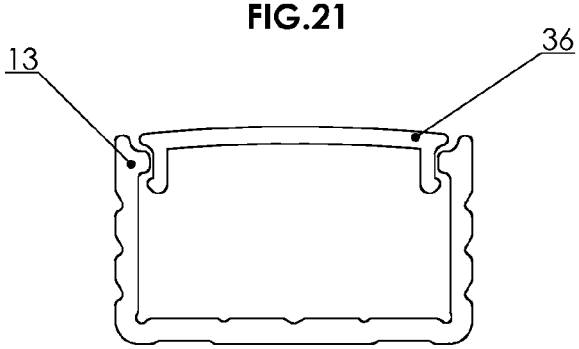
FIG. 22 illustrates a side view of the light engine housing, component 13, assembled with the extruded lens, component 36, in accordance with an exemplary embodiment of the present invention.
Figure 23:
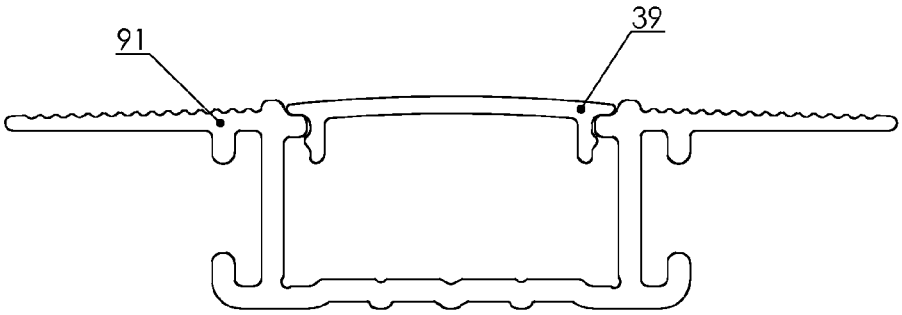
FIG. 23 illustrates a side view of other light engine housing, component 91, assembled with other lens, component 39, in accordance with an exemplary embodiment of the present invention.
Figure 24:
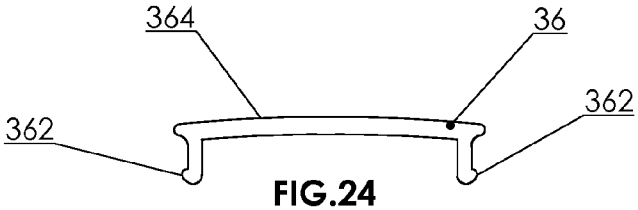
FIG. 24 illustrates a side view of optical element 36, in accordance with an exemplary embodiment of the present invention.
Figure 25:
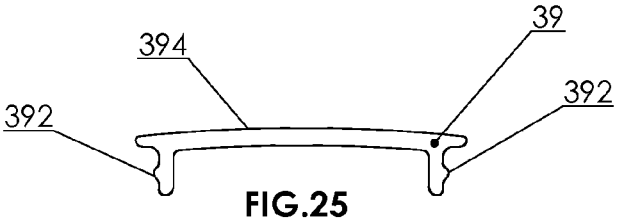
FIG. 25 illustrates a side view of another optical element 39, in accordance with an exemplary embodiment of the present invention.

FIG. 24 and FIG. 25 illustrates component 36 respectively 39, and they materialize the light diffusing/converting optical element. Alternatively, in another embodiment, the term "removable cover" is used in reference to component 36, within the scope of the invention, but not limited to that particular embodiment. The feature 362 or 392, representing one or more indents on the side of the lens, is intended to retain the lens to the housing but in the same time allow easy snap in of the lens to the housing, due to their elasticity properties. In one exemplary embodiment of this invention, the feature 362 of component 36, as depicted by FIG. 24, is defined as "complementary" to feature 132 of component 13, as depicted by FIG. 28, and working as a snap-fit connection, when the two components are put together, as illustrated in FIG. 22. Some examples of "complementary" located features are groves and ribs or protrusions and indentations. The surface 364 respectively 394, is the light output surface of the light diffusing/converting optical element. FIG. 24 and FIG. 25 are examples of extruded lens profiles intended for white light L.E.D. sources. The material for these lens or for the removable cover could be made of translucent or transparent plastic materials (i.e. acrylic, polycarbonate, polycarbonate with phosphor) or other light diffusing/converting optical grade materials.

In another embodiment of this invention, the spackle flange/cover 23 and the light diffusing element 36 could be formed as a single piece component.

The light source 73 is primarily comprised of multiple L.E.D. The technology could employ blue, white, RGB L.E.D. chips. The electrical circuit could be embedded into soft strips, FR boards, OL.E.D.s or any other electroluminescent diode that is capable of generating radiation in response to an electrical signal.

Figure 42:
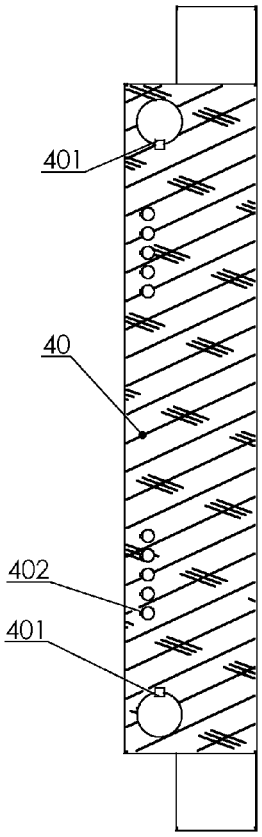
FIG. 42 illustrates a back view of component 40, named 'L.E.D. driver enclosure', in accordance with an exemplary embodiment of the present invention.

FIGS. 40, 41, 42, 43 and 44 illustrates different view angles of an L.E.D. driver enclosure (D.E.4) component 40. In FIG. 42, the feature 401 is a knockout intended to be removed if a strain relief device, like an elbow connector 46 depicted in FIG. 5, FIG. 6, FIG. 7 or FIG. 8, would need to be installed to the D.E.4 to provide power or data wires inside the enclosure. The "depth" of the driver enclosure is limited by the size of the structural elements. In an exemplary embodiment of this invention, an enclosure, mounted on a 2"×4" (2 inches by 4 inches) structural member, is considered "sufficiently recessed", if its depth, measured from its mounting surface, is less than 4 inches and its protrusions are less than the thickness of the planar surface into which it is installed.

The wiring of the L.E.D. driver enclosure (D.E.4) could be done thru any opening on the back of the enclosure ("knockout" holes, access hole and cover plate, etc.) There could be one, two or more K.O. that could receive one, two or more elbow connectors, first being to feed the power wires, a second one to feed the control wires (for example the 0-10V wires). The K.O. could be removed by pushing against the round cap from inside with a screw driver or other object having a diameter smaller than the K.O. diameter and being capable to withstand the force necessary to push the round cap until removed. The D.E.4 could be made of aluminum sheet metal or steel. The elbow could be an off the shelf item usually made of metals (zinc, steel, etc.).

Figures 9, 10, 11:
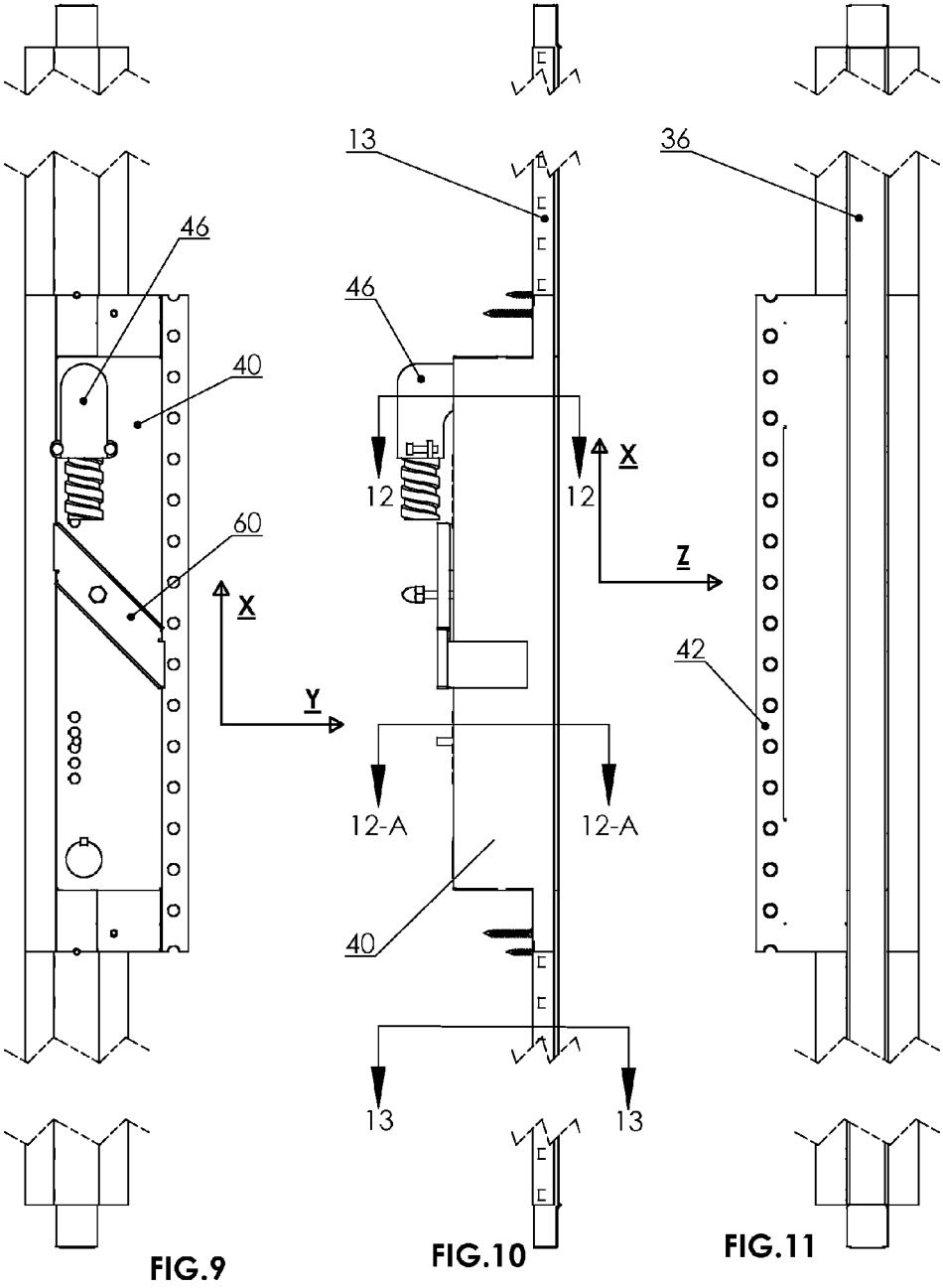
FIG. 9 illustrates a back view of a line segment of the concatenated run of elongated fixtures, in accordance with an exemplary embodiment of the present invention.
FIG. 10 illustrates a top view of a line segment of the concatenated run of elongated fixtures, in accordance with an exemplary embodiment of the present invention.
FIG. 11 illustrates a front view of a line segment of the concatenated run of elongated fixtures, in accordance with an exemplary embodiment of the present invention.
Figure 43:
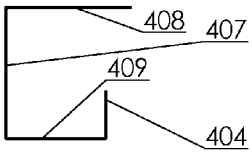
FIG. 43 illustrates a section view of component 40, taken along section line 43-43 as labeled in FIG. 40, in accordance with an exemplary embodiment of the present invention.

Continuing description of features at FIG. 42, the feature 402 represents an array of half-shear or smaller K.O. features intended for easy removal when a screw and nut needs to be installed either to mount the L.E.D. driver 45 directly or thru an intermediate bracket to the D.E.4 labeled 40. The hole 403 (FIG. 41) is intended to receive a self-tapping screw. The screw is mounting the P.I.S./H.-L.E channel segment 53 to D.E.4 component 40 and ensures electrical bonding of those two components. As illustrated in FIG. 43, the surface 407 is the back surface of D.E.4 component 40 that could serve as the mounting surface to L.E.D. driver or mounting brackets 58, depicted in FIG. 12 or FIG. 13. Alternatively, 408 or 409 surfaces could be used to support the footprint of the driver or mounting brackets. The installation of the D.E.4 compartment could be done by using a rotatable bracket 60 (FIG. 9 and FIG. 12).

Figure 44:
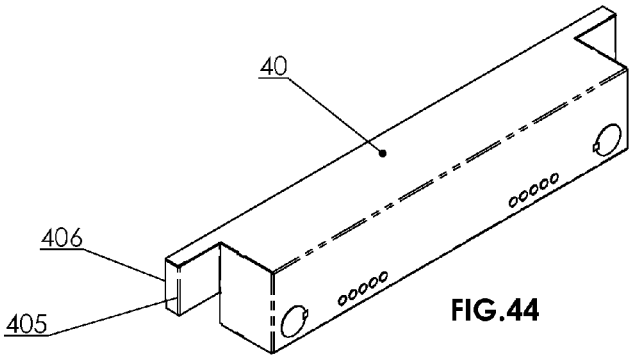
FIG. 44 illustrates an isometric view, rear perspective, of component 40 named 'L.E.D. driver enclosure', in accordance with an exemplary embodiment of the present invention.

On the back side of the driver enclosure we can see a set of small mounting K.O. arranged in any appropriate pattern to match the footprint of a series of L.E.D. drivers intended to be installed for every fixture configuration or by using intermediate mounting bracketing. The mounting of the driver depicted in the exemplary embodiment is not intended to restrict the other options that are not shown here as this driver could be installed on the other adjacent surfaces 408 or 409 of the driver enclosure D.E.4, as seen in FIG. 43. As seen in FIG. 44, the flange 406 would be capable to be flattened by an operator, at the fixture installation, if a wire way chase is going to be installed adjoined to the driver enclosure. The bend line 405 would be formed on a successive row of holes that are intended to weaken the strength of the flange, at the bend line, and to make it easier for an operator to flatten the flange and eventually remove it by twisting that piece until its material will suffer structural damage at the bend line which would allow the flange 406 to be separated from the electrical enclosure 40. As shown in FIG. 43, the tabs 404 are intended to support the access doors while they are shut and to stop them from swinging inside the electrical enclosure 40.

The enclosure 40 is considered as being "recessed" and, together with the elbow connector 46, intended to fit within the "depth" limitation of a particular space, labeled "D1", described in detail in application Ser. No. 14/810,714 incorporated herein by reference.

In general, an enclosure is considered "sufficiently recessed" if its depth, measured from its mounting surface, is less than "D1" and its protrusions are equal or less than the thickness of the planar surface "D" plus the thickness of the plaster, if any. The plaster thickness is usually between 1 mm to 6 mm. In general, the materials that are used to manufacture the electrical enclosures and the wire way chase integral to a channel, are: metals (carbon steel, stainless steel, aluminum, etc.), thermoset polyesters (i.e. fiberglass), thermoplastic (i.e. polycarbonate, ABS, etc.), polyesters, fire retardant plastics, etc.

Figure 45:
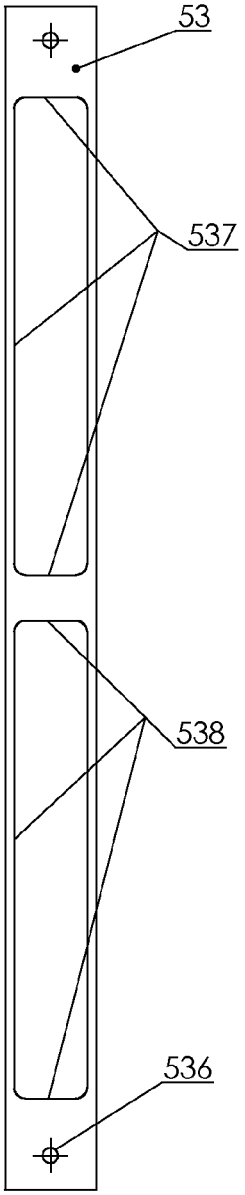
FIG. 45 illustrates a top view of component 53, named 'power input segment housing for light engine', in accordance with an exemplary embodiment of the present invention.
Figure 46:
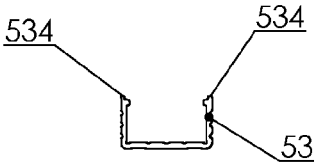
FIG. 46 illustrates a side view of component 53, named 'power input segment housing for light engine', in accordance with an exemplary embodiment of the present invention.

The power input segment/housing light engine or P.I.S./H.-L.E labeled 53 as illustrated in FIG. 45 thru FIG. 46 could be made out of sheet metal aluminum or steel. Alternate construction could be made out of extruded aluminum but it would require multiple secondary operations. This segment is intended to match the profile of the extruded light engine housing 13 or its variations, and to ensure row continuity along the lens lines. Also, it needs to allow for compliance inspection access, from the room side, to the wire splice compartment. Also, it needs to support the light sources. As illustrated in FIG. 46, the edges 534 are highly visible and are supposed to match or be accurately aligned with edges 131 of the component 13 as presented in FIG. 28. As depicted in FIG. 45, the opening for the access doors, perimeter 537 or 538 is formed as a closed loop shape, while each feature labeled 536 illustrate a countersink hole, which is intended to receive a self-tapping screw, on each side of the housing 53. The power access cover 59 could be installed either in 537 or 538 opening, depending on where the elbow fitting 46 is installed. While the soft strips 73 are installed on the access doors 55 and 59, the doors could be opened without removing the strips because the soft strips are flexible light engines. According to U.L. standard, a luminaire shall allow for inspection of branch circuit connections, after installation. Two minimum size openings, in the electrical enclosure, are supposed to allow passage of a rod having a diameter of ⅝" (16 mm) and these openings are covered by the access doors, in an exemplary embodiment of this invention.

As illustrated by FIG. 12, on top of the driver compartment there is a driver access cover 42 (or its alternative 23) that could be covered with plaster during the operating time of the fixtures, for aesthetic purpose. This cover could be removed if there is a need to replace the driver inside the D.E.4.

Figure 55:
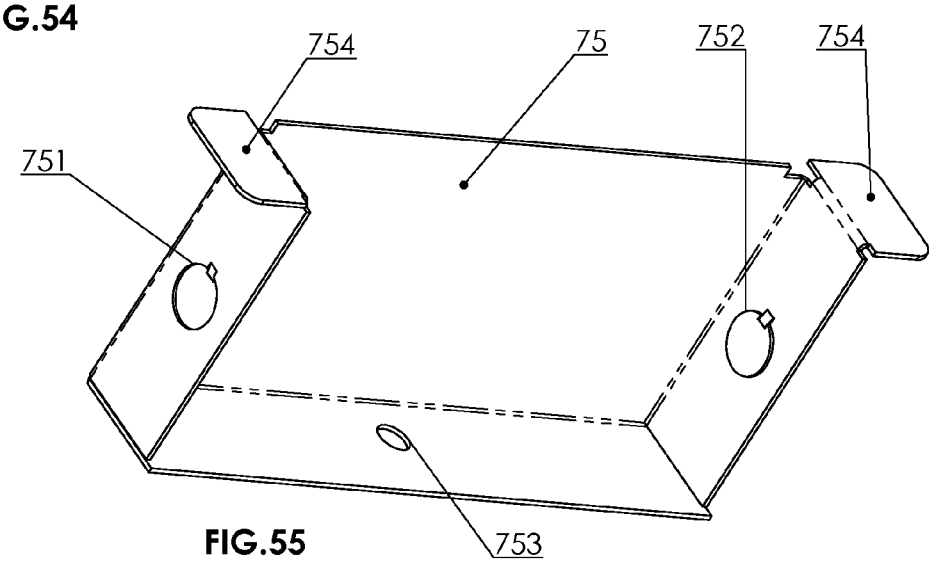
FIG. 55 illustrates a perspective view of component 75, named "internal junction box", in accordance with an exemplary embodiment of the present invention.
Figure 56:
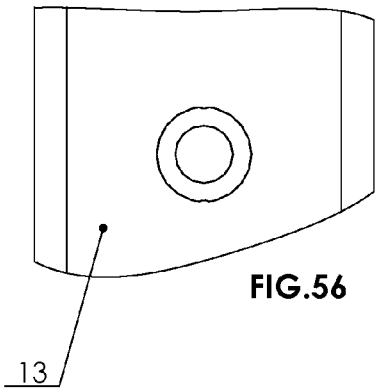
FIG. 56 illustrates a top view of mounting method of component 13, while component 18 was temporarily hidden in this view, in accordance with an exemplary embodiment of the present invention.
Figure 58:
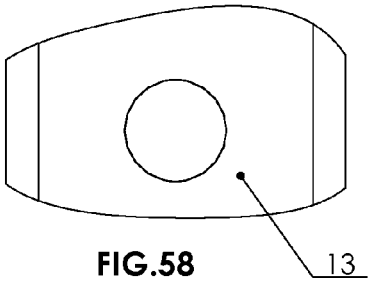
FIG. 58 illustrates a bottom view of another mounting method of component 13, while components 15 and 18 were temporarily hidden in this view, in accordance with an exemplary embodiment of the present invention.
Figure 57:
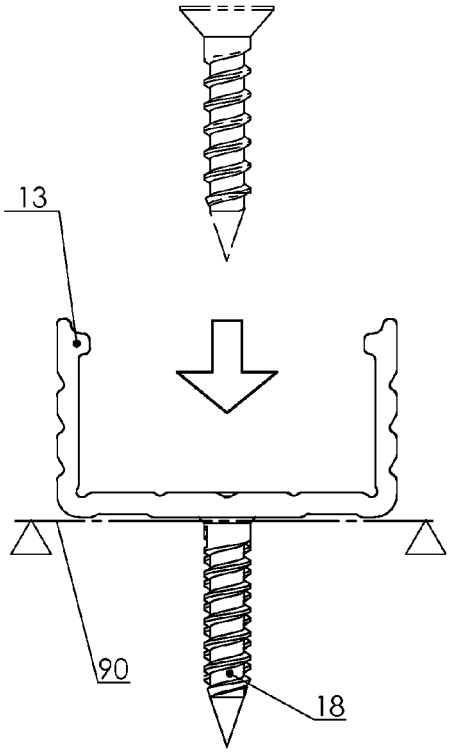
FIG. 57 illustrates a side view of mounting method of component 13, in accordance with an exemplary embodiment of the present invention.

FIG. 52, FIG. 53, FIG. 54 and FIG. 55 are illustrating different view angles of the internal junction box, component 75. In FIG. 55, the features 751 and 752 are "knockouts", intended to be removed, as needed, to install a bushing that would allow thru-wires to be safely inserted thru this opening. These wires are to be connected inside the junction box. The feature 753 is a hole intended for a self-tapping screw that would also be installed in a hole punched in the main D.E.4, to ensure electrical bonding between the two components. The two flanges, labeled 754, are intended to cover a larger clearance slot, formed in the component 53, for removal of the internal junction box while wires are inserted thru 751 and/or 752. As illustrated by FIG. 12 or FIG. 12-A, the wiring compartment could be contained by an "internal junction box", component 75 that is also intended to capture the additional L.E.D. tape, the soft strip connectors, the wire nuts and wires.

The envelope of the fixture components installed on the framework that is supporting the architectural surface is defined as having the thickness of the respective surface, labeled "D" as illustrated by FIG. 15. In one exemplary embodiment of this invention, the dimension "D" could take values ranging between ¼ inch to 2 inches. The spackle compound 81 and 82 is applied on the planar surface 80 after the installation of a complete row of fixtures and, in some configurations, before the lens 36 and the light source 73 installation. In other configurations, the light engine 73 and the lens 36 could be installed before the spackle compound is applied. Protective tape is recommended to cover the lens if the last option was chosen. This tape should be removed before the fixture is turned on.

A section view thru the driver compartment of the lighting system is presented in FIG. 12 and FIG. 12-A. Most of the components description could be found in previous paragraphs except the wire nuts 47 that are used in the industry to make quick connections between solid copper wires 48. In FIG. 12-A we can see the low voltage wires 49 inside the internal junction box 75.

Figure 59:
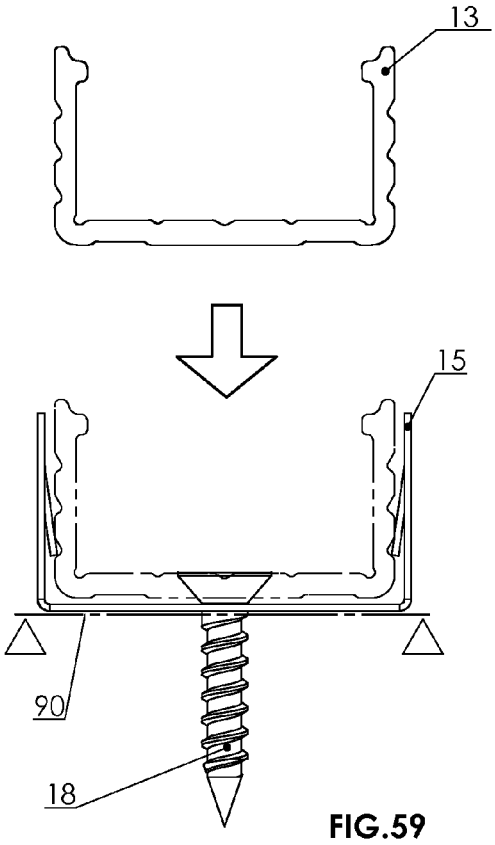
FIG. 59 illustrates a side view of another mounting method of component 13, in accordance with an exemplary embodiment of the present invention.

The linear fixtures could be installed as semi-recessed configuration, where only the D.E.4 is recessed while the light engine housings are above the planar surface. Other configuration could be when the light engine housings are surface mounted (for example, using a clip 15 as seen in FIG. 59).

Figure 61:
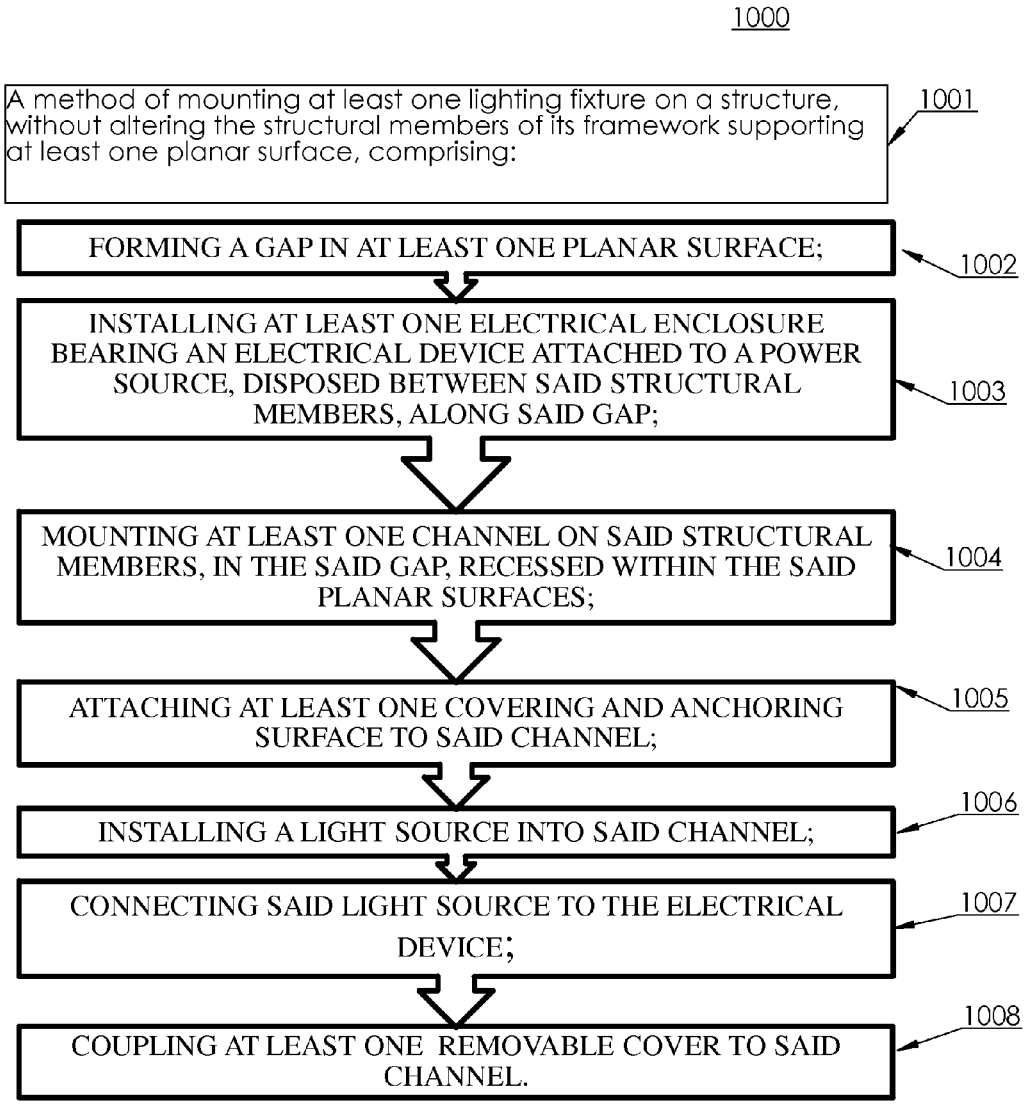
FIG. 61 illustrates a flow chart 1000 representing a method to assemble the elongated lighting fixtures, in accordance with an exemplary embodiment of the present invention.

In summary, these are the functions of the main components, or their features, as described previously:

Spackle flange/cover 23 or covering and anchoring surface
- a) prevent particle intrusion to the integral wire way compartment of the channel housing;
- b) support the spackle/plaster compound;
- c) prevent or reduce plaster cracking;

Spackle flange 86 (or its variations 83 or 84)
- a) support the spackle/plaster compound;
- b) prevent or reduce plaster cracking;

Internal junction box 75
- a) conceal additional L.E.D. tape;
- b) contains the wire splices, wire nuts;

Electrical enclosure 40
- a) contains the L.E.D. driver and driver mounting means (brackets, screw, etc.);
- b) contains the internal junction box 75;
- c) contains "knockouts" to be removed as needed, to install elbow connector(s);

Channel/light engine housing 13
- a) prevent dirt particles to reach the reflective surface, the optical surface or the L.E.D. chips;
- b) retain the light diffusing or light converting optical element;
- c) support the L.E.D. light source and transfer the heat out of the light engine;

wire way chase 20 is intended to:
- a) protect the high voltage wire according to the safety standards;
- b) contains T-slots intended to ensure alignment of multiple channels by inserting so-called "cleats" between them;
- c) allow holes to be drilled for mounting to the structure;
- d) contains screw chase features to ensure end caps mounting;
- e) support the spackle flange/cover;

power input segment/housing-light engine 53
- a) have an opening for the access doors;
- b) have mounting holes to attach the electrical enclosure;
- c) prevent dirt particles to reach the reflective surface, the optical surface or the L.E.D. chips;

light diffusing or light converting optical element 36
- a) diffuse and mix the light;
- b) spread the incident light rays coming from L.E.D. point source to a surface illumination;

In other exemplary embodiment, depicted by the process Flow chart 1000 of FIG. 61, we define (1001) a method of mounting at least one lighting fixture on a structure, without altering the structural members of its framework supporting at least one planar surface, comprising:

a. forming a gap in at least one planar surface (1002);
b. installing at least one electrical enclosure bearing an electrical device attached to a power source, disposed between said structural members, along said gap (1003);
c. mounting at least one channel on said structural members, in the said gap, recessed within the said planar surfaces (1004);
d. attaching at least one covering and anchoring surface to said channel (1005);
e. installing a light source into said channel (1006);
f. connecting said light source to the electrical device (1007); and
g. coupling at least one removable cover to said channel (1008).

Figure 62:
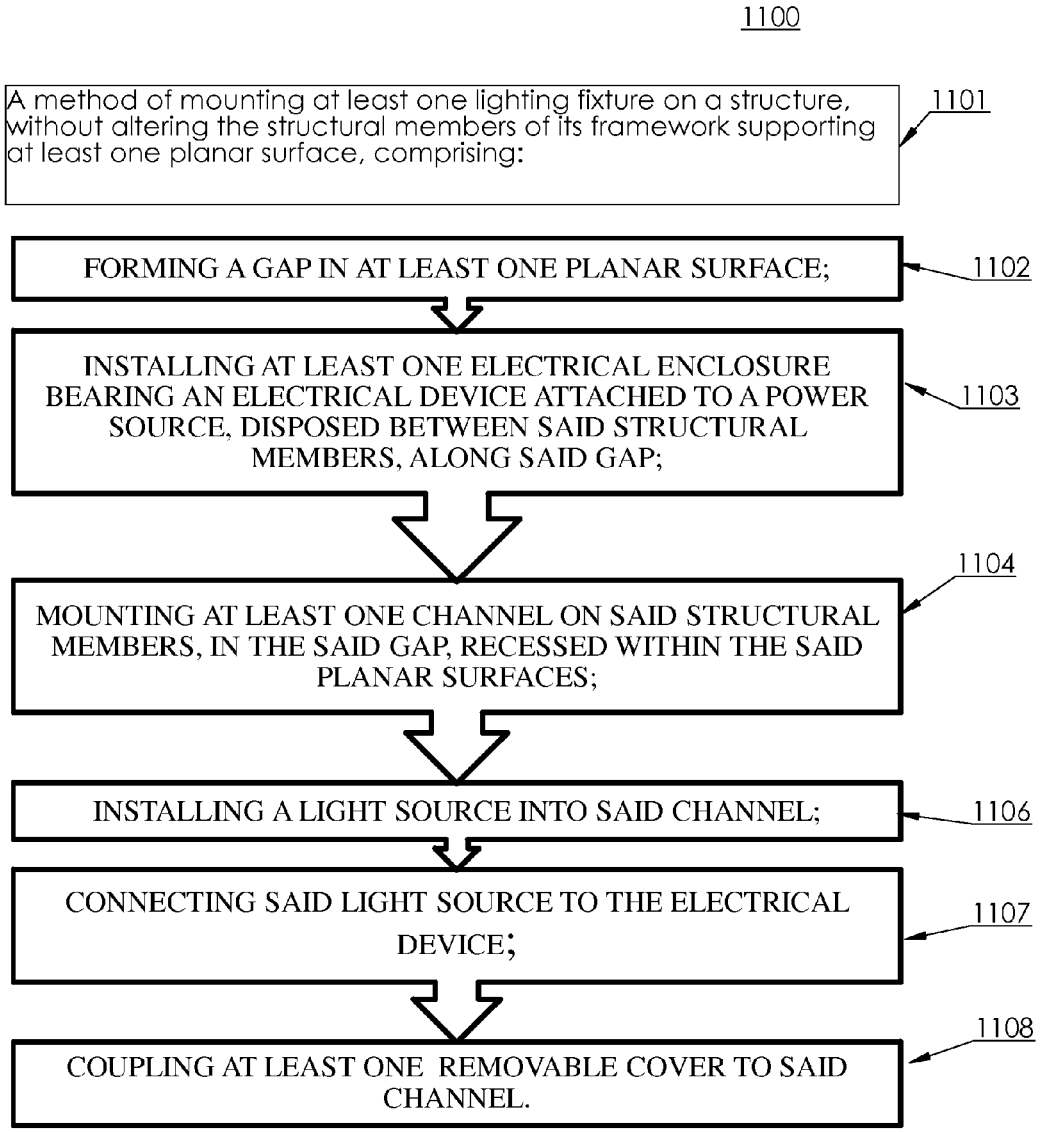
FIG. 62 illustrates a flow chart 1100 representing another method to assemble the elongated lighting fixtures, in accordance with an exemplary embodiment of the present invention.

In another exemplary embodiment, depicted by the process Flow chart 1100 of FIG. 62, we define (1101) a method of mounting at least one lighting fixture on a structure, without altering the structural members of its framework supporting at least one planar surface, comprising:

a. forming a gap in at least one planar surface (1102);
b. installing at least one electrical enclosure bearing an electrical device attached to a power source, disposed between said structural members, along said gap (1103);
c. mounting at least one channel on said structural members, in the said gap, recessed within the said planar surfaces (1104);
d. installing a light source into said channel (1106);
e. connecting said light source to the electrical device (1107); and
f. coupling at least one removable cover to said channel (1108).

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An elongated lighting fixture, intended to be installed on a structure without altering the structural members of its framework, comprising:

an enclosure, mounted on at least one structural member, wherein said enclosure is sufficiently recessed behind its mounting surface and containing an electrical device used as a power source and control;

a channel segment, adjoined said enclosure and mounted on at least one structural member bearing an opening to access said adjoining enclosure;

a junction box, adjoined to said channel segment, and located inside said enclosure;

a channel housing, abutted to and aligned with said channel segment and mounted on at least one structural member;

a wire way chase, mounted on at least one structural member, side by side and in the same direction with said channel;

a covering and anchoring surface for said wire way chase;

a light source, containing electroluminescent diodes, mounted in said channel, and connected to said electrical device; and, a removable cover, mounted on said channel;

wherein said channel segment would have at least one opening for maintenance access to said power source, after said fixture installation.

2. The lighting fixture of claim 1, wherein said covering and anchoring surface is substantially level with a planar surface and capable of being plastered and painted to match the planar surface into which it is installed.

3. The lighting fixture of claim 1, wherein said removable cover is purposed for diffusion of light or alteration of light wavelength.

4. The lighting fixture of claim 1, wherein said cover is purposed to be removed for the maintenance of said light source.

5. The lighting fixtures of claim 1, wherein said channel segment, could be removed and re-installed, without damaging the surrounding finished surfaces, for maintenance or replacement of said electrical device.

6. The lighting fixture of claim 1, wherein said electrical enclosure would have at least one access door, on the channel side, for wire splice inspection and to conceal the additional L.E.D. tape, inside of said electrical enclosure.

7. The electrical enclosure of claim 6, wherein at least one access door could be opened while the L.E.D. light source is attached to it.

8. The access door of claim 7, that could be manufactured from the same body of said channel segment, by cutting a perimeter defining its shape and leaving at least a small bridge of material that could be twisted but not cleaved when a regular force is applied by an operator with the intent to open the doors.

9. The lighting fixture of claim 1, wherein said opening to access said adjoining enclosure has a hinged joint for opening an access door or a sliding plate enabling easy access to adjoining enclosure.

10. The lighting fixtures of claim 1, that is to be joined with other fixture, by at least one alignment plate.

11. The lighting fixture of claim 1, wherein said channel contains a heat-conducting material.

12. A method of mounting at least one lighting fixture on a structure, without altering the structural members of its framework supporting at least one planar surface, comprising:

a) forming a gap in at least one planar surface;

b) installing at least one electrical enclosure bearing an electrical device attached to a power source, disposed between said structural members, along said gap;

c) mounting at least one channel on said structural members, in the said gap, recessed within the said planar surfaces;

d) attaching at least one covering and anchoring surface to said channel;

e) installing a light source into said channel;

f) connecting said light source to the electrical device; and g) coupling at least one removable cover to said channel.

13. The lighting fixture arrangement of claim 12, comprising multiple lighting fixtures connected end to end, as a continuous run, and positioned to follow the direction of adjacent planar surfaces in three dimensional spaces while maintaining the structural integrity of the supporting framework.

14. An elongated light fixture housing comprising:

a channel housing with an outer surface and an inner surface, having at least one indentation or at least a grooved surface on its inner profile integrally formed on its inner surface, in at least one of its side walls having one or more complementary located flexible locking features;

a removable cover having one or more complementary located flexible locking features with an outer surface and an inner surface, having at least one complementary indentation or ribbed surface integrally formed on its outer surface, wherein indentation or grooved surface of said channel is for receiving and retaining said complementary indentation or ribbed surface of said removable cover;

wherein said complementary located flexible locking features engage functioning as a snap-fit cover attachment system for the elongated light fixture.

15. The light fixture housing of claim 14, wherein said removable cover would be manually pressed fit and locked inside the channel housing.

16. The light fixture housing of claim 14, wherein said channel contains a heat-conducting material.

17. The light fixture housing of claim 14, wherein said cover can be mechanically coupled, for a snap-lit attachment to said channel, by applying a threshold force on the surface that is external to its shape, until the corresponding flexible locking features of the two components are engaged and locked relative to each other.

18. The light fixture housing of claim 14, wherein said cover can be disengaged and manually removed by applying a threshold force opposite to the force needed to engage the two components.

19. The light fixture housing of claim 14, wherein said removable cover is purposed for diffusion of light or alteration of light wavelength.

20. The light fixture housing of claim 14, wherein said cover is purposed to be removed for the maintenance of said light source.

21. The light fixture housing of claim 14, that is to be joined with other fixture, by at least one alignment plate.

22. A method of mounting at least one lighting fixture on a structure, without altering the structural members of its framework supporting at least one planar surface, comprising:

a) forming a gap in at least one planar surface;

b) installing at least one electrical enclosure bearing an electrical device attached to a power source, disposed between said structural members, along said gap;

c) mounting at least one channel on said structural members, in the said gap, recessed within the said planar surfaces;

d) installing a light source into said channel;

e) connecting said light source to the electrical device; and f) coupling at least one removable cover to said channel.

* * * * *